US011820635B2

(12) United States Patent
Confer et al.

(10) Patent No.: US 11,820,635 B2
(45) Date of Patent: Nov. 21, 2023

(54) SYSTEMS AND METHODS FOR POSITIONING A COUNTERWEIGHT ON A MATERIAL HANDLING VEHICLE

(71) Applicant: The Raymond Corporation, Greene, NY (US)

(72) Inventors: Thomas W. Confer, Chenango Forks, NY (US); David B. Howe, Binghamton, NY (US)

(73) Assignee: The Raymond Corporation, Greene, NY (US)

( * ) Notice: Subject to any disclaimer, the term of this patent is extended or adjusted under 35 U.S.C. 154(b) by 679 days.

(21) Appl. No.: 16/833,219

(22) Filed: Mar. 27, 2020

(65) Prior Publication Data

US 2020/0317485 A1 Oct. 8, 2020

Related U.S. Application Data

(60) Provisional application No. 62/830,102, filed on Apr. 5, 2019.

(51) Int. Cl.
*B66F 9/075* (2006.01)
*B66F 9/07* (2006.01)

(52) U.S. Cl.
CPC ..... *B66F 9/07554* (2013.01); *B66F 9/07531* (2013.01); *B66F 9/07* (2013.01)

(58) Field of Classification Search
CPC ..... B66F 9/07554; B66F 9/07531; B66F 9/07
See application file for complete search history.

(56) References Cited

U.S. PATENT DOCUMENTS 3,061,034 A * 10/1962 Hoyt ..... B66F 9/07554 180/68.5
4,067,415 A 1/1978 Samide
4,221,530 A 9/1980 Williams, IV
4,232,883 A * 11/1980 Bourgeous ..... B62D 49/085 180/312
4,580,650 A 4/1986 Matsuda
(Continued)

FOREIGN PATENT DOCUMENTS

AU 2020202219 A1 * 10/2020 ..... B66C 23/72
CA 3077529 A1 * 10/2020 ..... B66C 23/72
(Continued)

OTHER PUBLICATIONS

European Patent Office. Extended European Search Report for application 20167193.0. dated Aug. 26, 2020.

*Primary Examiner* — Jacob B Meyer
(74) *Attorney, Agent, or Firm* — Quarles & Brady LLP

(57) ABSTRACT

A material handling vehicle is provided, which includes a frame having an aperture directed through the frame and configured to receive a battery pack, and a counterweight assembly. The counterweight assembly includes a counterweight having a first opening, and an opposite second opening, a first positioning rod having a first end, and an opposite second end. The first end is directed through the first opening. A first nut is threadingly engaged with the second end of the first positioning rod. The first nut is rotated in a first direction to advance the first end of the first positioning rod farther through the first opening to contact the frame, thereby adjusting the position of the counterweight relative to the frame.

20 Claims, 26 Drawing Sheets

(56) References Cited

U.S. PATENT DOCUMENTS

| | | | | | |
|---|---|---|---|---|---|
| 6,142,426 | A * | 11/2000 | Zaro | ..... | B61L 29/00 16/400 |
| 7,896,117 | B2 | 3/2011 | Jung | | |
| 2008/0083261 | A1* | 4/2008 | Chen | ..... | G01G 1/26 73/1.13 |
| 2020/0317485 | A1* | 10/2020 | Confer | ..... | B66F 9/07531 |

FOREIGN PATENT DOCUMENTS

| | | | | | |
|---|---|---|---|---|---|
| CN | 108773799 | A | * | 11/2018 | ..... B66F 9/07554 |
| CN | 112623976 | A | * | 4/2021 | |
| CN | 113307183 | A | * | 8/2021 | ..... B66F 9/06 |
| CN | 114197566 | A | * | 3/2022 | ..... B66C 23/185 |
| CN | 215968866 | U | * | 3/2022 | |
| CN | 216303122 | U | * | 4/2022 | |
| CN | 114455486 | A | * | 5/2022 | |
| CN | 114476991 | A | * | 5/2022 | |
| CN | 217270144 | U | * | 8/2022 | |
| EP | 3718955 | A1 | * | 10/2020 | ..... B66C 23/72 |
| EP | 3725730 | A1 | * | 10/2020 | |
| JP | S57151472 | A | | 9/1982 | |
| JP | H05162543 | A | | 6/1993 | |
| JP | H1160183 | A | | 3/1999 | |
| KR | 20080060584 | A | | 7/2008 | |

* cited by examiner

SYSTEMS AND METHODS FOR POSITIONING A COUNTERWEIGHT ON A MATERIAL HANDLING VEHICLE

CROSS-REFERENCES TO RELATED APPLICATIONS

The present application is based on and claims priority to U.S. Provisional Patent Application No. 62/830,102, filed Apr. 5, 2019, and entitled "Systems and Methods for Positioning a Counterweight." The entire disclosure of which is incorporated herein by reference in its entirety.

STATEMENT REGARDING FEDERALLY SPONSORED RESEARCH

Not Applicable.

BACKGROUND

This disclosure relates generally to material handling vehicle components and, more particularly, to self-positioning counterweights.

Material handling vehicles (e.g., forklifts, cranes, etc.) generally include counterweights situated rearwardly relative to the forks or other load engaging structures. Counterweights on a material handling vehicle helps provide stability. For example, when a material handling vehicle engages a load, the counterweight offsets at least a portion of the weight of the load (e.g., due to the opposing moment). This can be helpful while the material handling vehicle is traveling with a load.

Counterweights can be formed out of many different materials, which are typically dense to provide a relatively heavy, but small spatial footprint for the material handling vehicle. The counterweight is then mounted by fasteners to the rearward portion of the material handling vehicle frame. However, the coupling of the counterweight with fasteners prevents adjustments in the positioning of the counterweight.

Thus, it would be desirable to have improved systems and methods for positioning a counterweight on a material handling vehicle.

BRIEF SUMMARY

As explained herein, the present disclosure provides for positioning of counterweights. In some embodiments, counterweight positioning systems according to some embodiments can include rods, pins, wedges, disks, etc. to engage with material handling vehicle bodies (e.g., frames).

Systems and methods are provided for positioning a counterweight. Some embodiments of the disclosure provide a material handling vehicle comprising: a frame having an aperture directed through the frame and configured to receive a battery pack; and a counterweight assembly including: a counterweight having a first opening, and an opposite second opening; a first positioning rod having a first end, and an opposite second end, the first end being directed through the first opening; and a first nut threadingly engaged with the second end of the first positioning rod, and wherein the first nut is rotated in a first direction to advance the first end of the first positioning rod farther through the first opening to contact the frame, thereby adjusting the position of the counterweight relative to the frame.

In some embodiments, the first nut is an adjusting shaft having a hole directed therethrough, a first portion, and a second portion opposite the first portion, the first portion having first threads, and the second portion having second threads, the first threads being opposite in direction to the second threads, and wherein the first portion threadingly engages the second end of the first positioning rod.

In some embodiments, the frame includes a first slot directed into the frame, and a second slot opposite the first slot directed into the frame, wherein the counterweight assembly includes a second positioning rod having a third end, and an opposite fourth end, the third end being directed through the second opening, the fourth end threadingly engaged with the second portion of the adjusting shaft, and wherein the adjusting shaft is rotated in the first direction to advance the first end of the first positioning rod through the first opening by a first amount and into the first slot of the vehicle frame, and to retreat the fourth end of the second position rod through the second opening by a second amount, thereby adjusting the position of the counterweight relative to the frame.

In some embodiments, the first amount and the second amount are the same, such that rotation of the adjusting shaft causes advancement of the first positioning rod and retreating of the second position rod by the same amount.

In some embodiments, the counterweight has a cavity directed therethrough, and wherein the adjustment shaft is positioned within the cavity.

In some embodiments, the first slot, the second slot, the first opening, and the second opening are all collinear.

In some embodiments, the counterweight assembly further includes a first washer, and a second washer, the first washer positioned in the cavity and between the first portion of the adjusting shaft and the first positioning rod, and wherein the second washer is positioned in the cavity and between the second portion of the adjusting shaft and the second positioning rod.

In some embodiments, the first slot of the counterweight, the first end of the first positioning rod, and the first slot of the vehicle frame all have the same shape. In some embodiments, the shape is a rectangular prism.

In some embodiments, the material handling vehicle includes a mounting structure coupled to the counterweight and configured to engage with and secure the battery pack, and wherein the adjustment of the position of the counterweight relative to the frame adjusts the position of the mounting structure relative to the aperture of the frame.

In some embodiments, the material handling vehicle includes a cover pivotally coupled to the frame, the cover configured to interface with the counterweight.

In some embodiments, the counterweight assembly further includes: a second positioning rod having a third end, and an opposite fourth end, the fourth end being directed through the second opening; and a second nut threadingly engaged with the third end of the second positioning rod, and wherein rotation of the second nut in the first direction advances the fourth end of the second positioning rod farther through the second opening and into the second slot of the vehicle frame, thereby adjusting the position of the counterweight relative to the frame.

In some embodiments, the counterweight includes a first cavity, and a second cavity, wherein the first nut is positioned in the first cavity, and wherein the second nut is positioned in the second cavity.

Some embodiments of the disclosure provide a counterweight assembly for a material handling vehicle, the material handling vehicle including a frame having a first slot directed into the vehicle frame, and a second slot opposite the first slot directed into the vehicle frame, and an aperture directed through the frame configured to receive a battery pack, the counterweight assembly comprising: a counterweight having a first opening, and an opposite second opening; a first positioning rod having a first end, and an opposite second end, the first end being directed through the first opening; and a first nut threadingly engaged with the second end of the first positioning rod, and wherein the first nut is rotated in a first direction to advance the first end of the first positioning rod farther through the first opening and into the first slot of the vehicle frame, thereby adjusting the position of the counterweight relative to the frame.

In some embodiments, the counterweight assembly further includes a mounting structure coupled to the counterweight and configured to engage with and secure the battery pack, and wherein the adjustment of the position of the counterweight relative to the frame adjusts the position of the mounting structure relative to the aperture of the frame.

In some embodiments, the counterweight is configured to engage with a cover pivotally coupled to the frame of the material handling vehicle.

In some embodiments, the first nut is an adjusting shaft having a hole directed therethrough, a first portion, and a second portion opposite the first portion, the first portion having first threads, and the second portion having second threads, the first threads being opposite in direction to the second threads, the first portion of the adjusting shaft being threadingly engaged with the second end of the positioning rod, and the counterweight assembly further comprising a second positioning rod having a third end, and an opposite fourth end, the fourth end being directed through the second opening, and the fourth end of the second positioning rod being threadingly engaged with the second portion of the adjusting shaft.

Some embodiments of the disclosure provide a method for installing a counterweight on a material handling vehicle, the method comprising: providing a counterweight assembly including: a counterweight; and a counterweight positioning system having a first positioning member, and a second positioning member; placing the counterweight on a frame of the material handing vehicle; advancing the first positioning member until the first positioning member contacts the frame; and advancing the second positioning member until the second positioning member contacts the frame.

In some embodiments, the frame has a first side, and an opposite second side, and the method further comprising: retreating the first positioning member towards the counterweight and away from the first side of the frame; moving the counterweight towards the first side of the frame; and advancing the second positioning member to extend farther from the counterweight and until the second positioning member contacts the second side of the frame.

In some embodiments, the frame has a first side, and an opposite second side, and the method further comprising: retreating the second positioning member towards the counterweight and away from the second side of the frame; moving the counterweight towards the second side of the frame; and advancing the first positioning member to extend farther from the counterweight and until the first positioning member contacts the first side of the frame.

Some embodiments of the disclosure provide a counterweight assembly that includes a counterweight, a positioning rod, and a nut. The positioning rod is slidably engaged and rotationally fixed with the counterweight. The nut is threadingly engaged with the positioning rod and slidably engaged with the counterweight.

In some embodiments, the positioning rod is a first positioning rod, and the nut is a first nut; and the counterweight assembly further comprises: a second positioning rod slidably engaged and rotationally fixed with the counterweight; and a second nut threadingly engaged with the positioning rod and slidably engaged with the counterweight.

Some embodiments of the disclosure provide a counterweight assembly that includes a counterweight, a position adjustment wedge, a positioning rod, and an adjustment screw. The position adjustment wedge is slidably disposed in the counterweight. The positioning rod is slidably engaged with the position adjustment wedge. The adjustment screw is threadingly engaged with the position adjustment wedge.

In some embodiments, the position adjustment wedge is a first position adjustment wedge, the positioning rod is a first positioning rod, and the adjustment screw is a first adjustment screw; and the counterweight assembly further comprises: a second position adjustment wedge slidably disposed in the counterweight a second positioning rod slidably engaged with the second position adjustment wedge; and a second adjustment screw threadingly engaged with the second position adjustment wedge.

Some embodiments of the disclosure provide a counterweight assembly that includes a counterweight, a position linkage assembly, and an adjustment screw. The position linkage assembly is disposed in the counterweight and includes a position adjustment block, a link, and a positioning rod. The link is pivotably engaged with the position adjustment block. The positioning rod is pivotably engaged with the link. The adjustment screw is threadingly engaged with the position adjustment block.

In some embodiments, the position linkage assembly is a first position linkage assembly, the position adjustment block is a first position adjustment block, the link is a first link, the positioning rod is a first positioning rod, and the adjustment screw is a first adjustment screw; and the counterweight assembly further comprising: a second position linkage assembly disposed in the counterweight and comprising: a second position adjustment block, a second link pivotably engaged with the second position adjustment block, and a second positioning rod pivotably engaged with the second link; and a second adjustment screw threadingly engaged with the second position adjustment block.

Some embodiments of the disclosure provide a counterweight assembly that includes a counterweight, a position adjustment wedge, and an adjustment screw. The position adjustment wedge is slidably disposed in the counterweight. The adjustment screw is slidably engaged with the position adjustment wedge and threadingly engaged with the counterweight.

In some embodiments, the position adjustment wedge is a first position adjustment wedge, and the adjustment screw is a first adjustment screw; and the counterweight assembly further comprises a second position adjustment wedge slidably disposed in the counterweight; and a second adjustment screw slidably engaged with the second position adjustment wedge and threadingly engaged with the counterweight.

Some embodiments of the disclosure provide a counterweight assembly that includes a counterweight, a pivot screw, a positioning screw, and a positioning disk. The counterweight defines a recess. The pivot screw is threadingly engaged with the counterweight. The positioning screw is threadingly engaged with the counterweight. The positioning disk is slidably disposed in the recess, rotatably engaged with the pivot screw, and slidably engaged with the positioning screw.

In some embodiments, the recess is a first recess, the counterweight defines a second recess, the pivot screw is a first pivot screw, the positioning screw is a first positioning screw, and the positioning disk is a first positioning disk; and the counterweight assembly further comprises: a second pivot screw threadingly engaged with the counterweight; a second positioning screw threadingly engaged with the counterweight; and a second positioning disk slidably disposed in the second recess, rotatably engaged with the second pivot screw, and slidably engaged with the second positioning screw.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
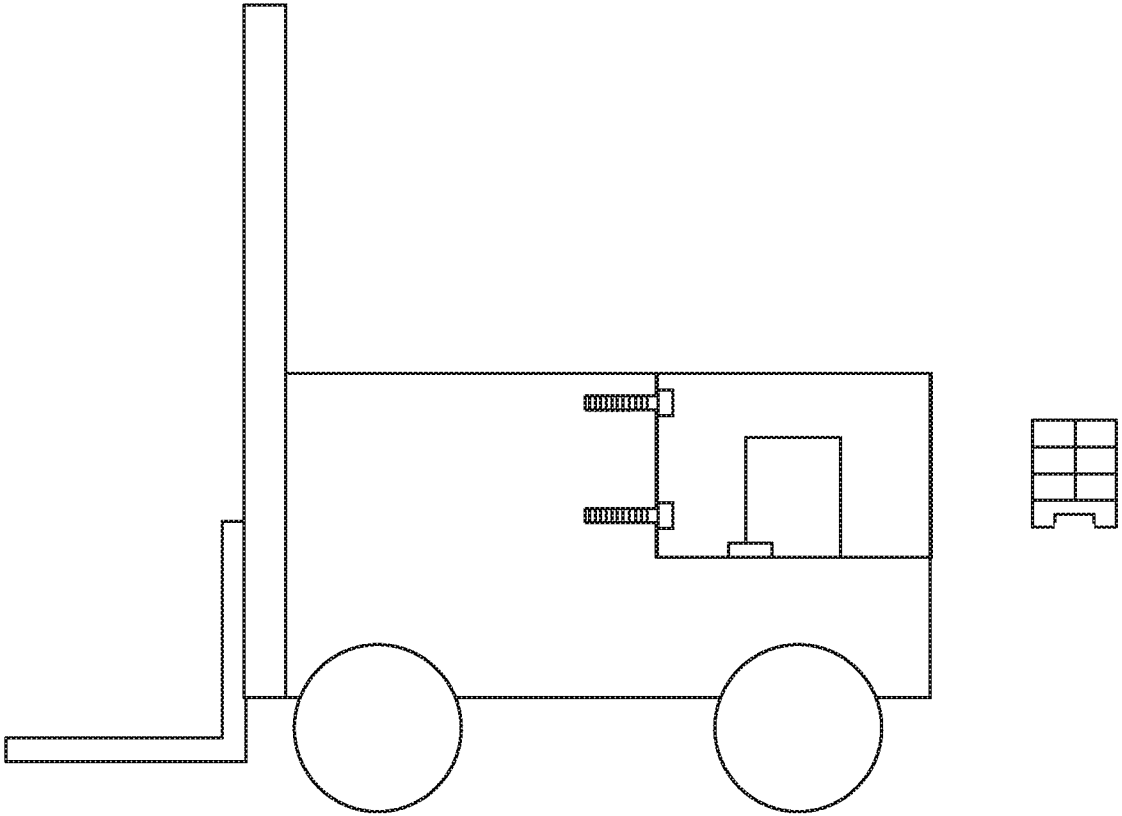
FIG. 1 shows an illustration of a material handling vehicle.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also, it is to be understood that the use the phraseology and terminology used herein is for the purpose of description and should not be regarded as limiting. Furthermore, the use of "right", "left", "front", "back", "upper", "lower", "above", "below", "top", or "bottom" and variations thereof herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Unless otherwise specified or limited, phrases similar to "at least one of A, B, and C," "one or more of A, B, and C," etc., are meant to indicate A, or B, or C, or any combination of A, B, and/or C, including combinations with multiple or single instances of A, B, and/or C.

Certain operations of methods according to the invention, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the invention. Further, in some embodiments, certain operations can be executed in parallel, including by dedicated parallel processing devices, or separate computing devices configured to interoperate as part of a large system.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. Skilled artisans will recognize the non-limiting examples provided herein have many useful alternatives and fall within the scope of the present disclosure.

There are typically two main groupings of material handling vehicles: (1) fuel powered vehicles, and (2) electrically (e.g., battery) powered vehicles. Fuel powered material handling vehicles typically do not have other heavy components, as the fuel (e.g., liquid gasoline, or fuel gas, such as propane) required to power this type of material handling vehicle while light, is energy dense. Thus, counterweights interfacing with this type of material handling vehicle are typically formed of heavy casted metals, and are mounted to the vehicle frame with fasteners. Electrically powered material handling vehicles typically require heavy electrical sources, such as batteries, to provide power to the material handling vehicle. Typically, these heavy batteries are implemented as lead acid batteries, and are generally positioned within the vehicle housing (e.g., within a lower portion of the vehicle frame). Thus, similarly to fuel powered material handling vehicles, electrical powered material handling vehicles having lead acid batteries also have similar counterweights (e.g., heavy casted metal counterweights).

Recently, electrically powered material handling vehicles have expanded battery choices to include lithium ion batteries, among others. Use of lithium ion batteries can decrease the total footprint (or size) of the batteries required for powering the vehicle. Thus, because lead acid batteries may not be required to be installed in the lower portion of the frame, other (or alternative) mounting locations for lithium ion batteries could then be contemplated. One such location that has recently been contemplated is the storage of the batteries within the internal volume of the counterweight. This location is particularly advantageous at least because this location allows for the batteries, which can be denser than the counterweight material, to either increase the overall weight of the counterweight, or in some cases, can prevent the need of counterweights to be formed out of dense materials. In other words, the batteries when stored inside a counterweight of less dense material (e.g., a frame and sheet metal) can provide a desirable load offset (e.g., an opposing moment) for a load engaged with the vehicle (e.g., by the forks). The movement away from relatively dense counterweight constructions allowed for other structures to be coupled to or positioned to or within the counterweight. For example, some mounting structures, such as those that easily engage and secure a battery pack containing batteries have been contemplated for installment inside the internal volume of the counterweight. As another example, in order to quickly access the battery pack, covers that cover, and encapsulate the batteries, typically interface with the frame of the material handling vehicle.

Batteries are typically configured as a battery pack allowing for routine installation (or removal) of the batteries from the counterweight. In some configurations, the battery pack is placed through an aperture (or window) in the vehicle frame and is then slidingly engaged to a mounting structure, which is coupled (or affixed) to the counterweight. In some cases, the positioning of the mounting structure relative to the aperture (or window) in the vehicle frame prevents the battery pack from properly interfacing with the mounting structure, and being received in the aperture in the vehicle frame. In other words, with the counterweight installed (e.g., with fasteners), the spatial relationship between the mounting structure and the aperture of the vehicle frame is substantially fixed. Thus, if the mounting structure does not properly align with the aperture in the vehicle frame, the battery pack will abut against the vehicle frame, and the battery pack cannot be received in the counterweight (e.g., via engagement with the mounting structure).

As another example, a cover that is pivotally connected to the vehicle frame can interface with the counterweight. The cover can allow a user to quickly access the contents within the counterweight, such as the battery pack (e.g., to provide power to the battery back, via a cable). Additionally, the cover can be formed out of other materials (e.g., plastics), and thus the shape, color, etc., can be more ascetically pleasing. In some cases, there may be manufacturing variability of the cover, frame, or counterweight, and a cover may not seat on the counterweight.

Embodiments of the disclosure provide counterweight systems, and embodiments for positioning and centering a counterweight. For example, some systems and methods according to some embodiments of the disclosure provide a counterweight assembly that is configured to adjust the position of the counterweight relative to the frame. This way, the mounting structure that receives the batteries (e.g., the battery pack) and is connected to the counterweight, can be adjusted accordingly so as to allow alignment between the mounting structure and the aperture in the vehicle frame. Similarly, moving the counterweight allows for engagement between the cover and the counterweight.

FIG. 1 shows an illustration of a material handling vehicle having a vehicle frame with an aperture, a mounting structure connected to the counterweight, and a battery back that slidingly engages with the mounting structure. As shown, the counterweight is secured to the frame using fasteners (e.g., bolts).

Figure 2:
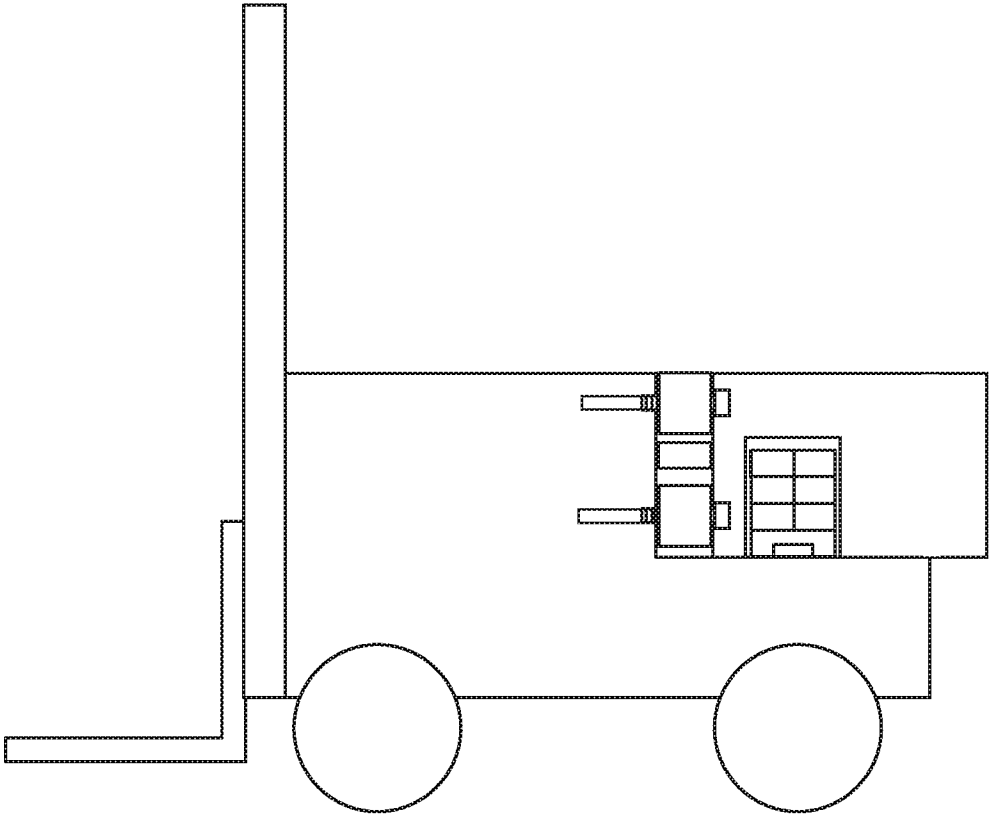
FIG. 2 shows an illustration of the material handling vehicle of FIG. 2, with spacers positioned between a counterweight and the frame.

FIG. 2 shows an illustration of the material handling vehicle of FIG. 1, with the use of spacers. As shown in FIG. 2, spacers have been received between the counterweight and vehicle frame, to shift the position of the counterweight rearwardly (e.g., by the thickness of the spacers).

Figure 3:
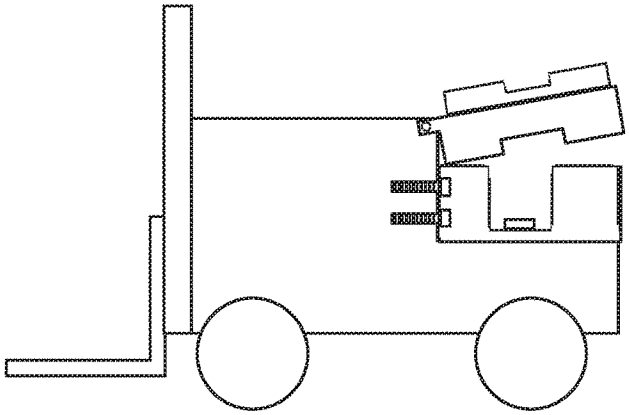
FIG. 3 shows an illustration of another material handling vehicle with a pivotally attached cover, and a counterweight.

FIG. 3 shows an illustration of a material handling vehicle having a vehicle frame with an aperture, a counterweight with a mounting structure, and a cover that is pivotally attached to the frame. As shown in FIG. 3, when the counterweight is installed on the frame (e.g., with fasteners), there may be interference between the counterweight and the cover.

Figure 4:
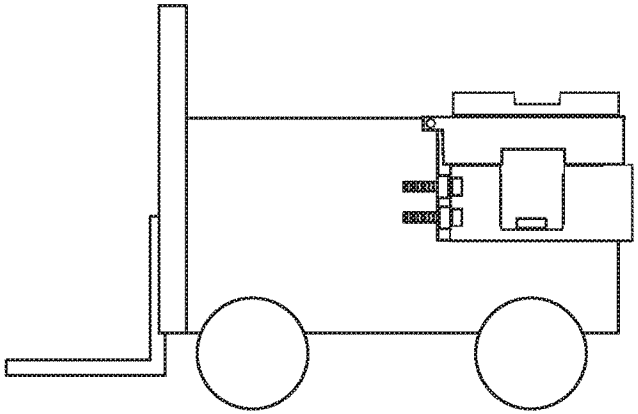
FIG. 4 shows an illustration of the material handling vehicle of FIG. 3, with spacers positioned between a counterweight and the frame.

FIG. 4 shows an illustration of the material handling vehicle of FIG. 3. As shown, spacers have been positioned between the counterweight and vehicle frame, to shift the position of the counterweight rearwardly (e.g., by the thickness of the spacers).

Figure 5:
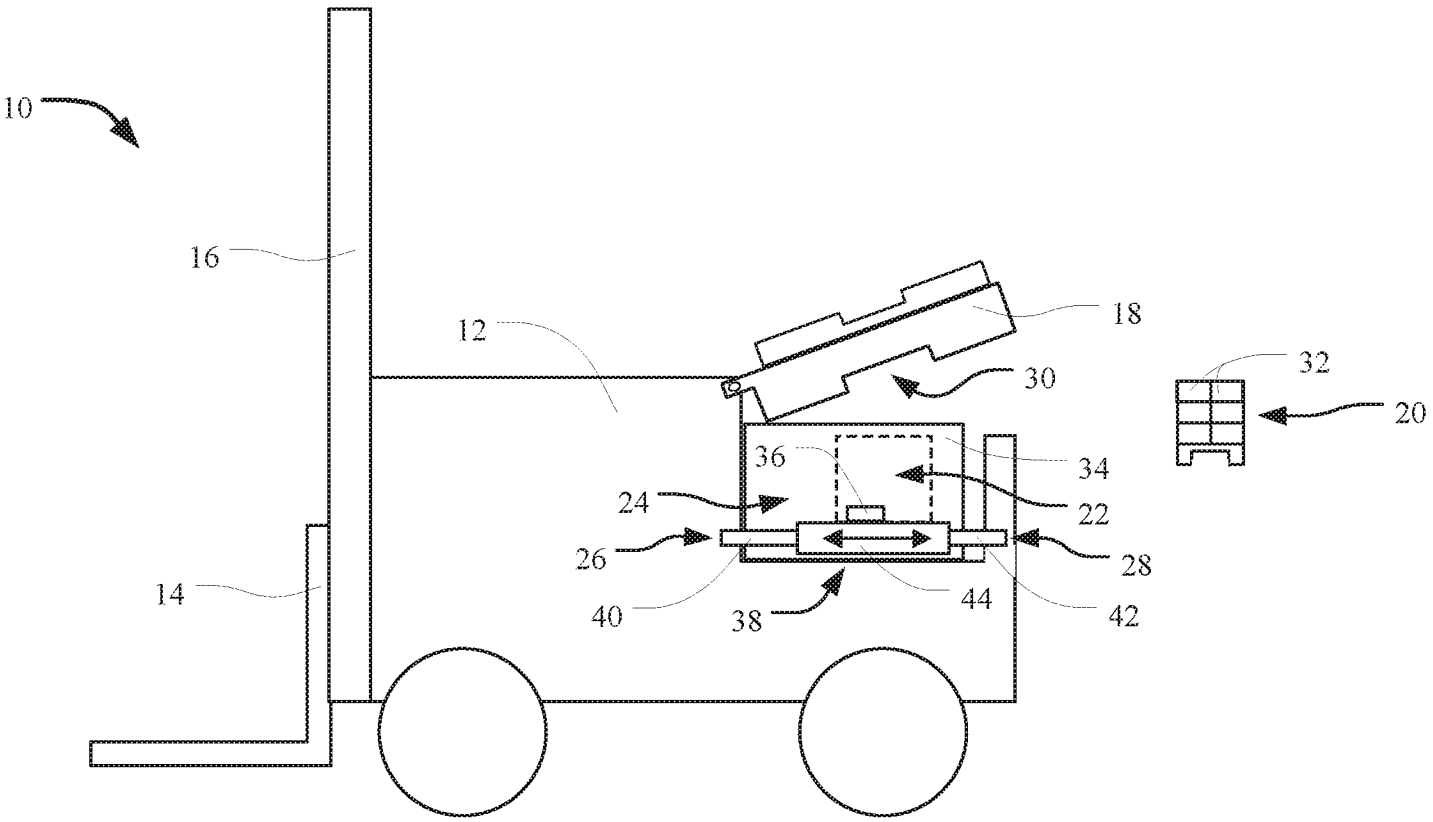
FIG. 5 shows an illustration of another material handling vehicle having a counterweight.

FIG. 5 shows an illustration of a material handling vehicle 10, according to some embodiments of the disclosure. The material handling vehicle 10 includes a frame 12, forks 14, a mast 16, a cover 18 pivotally coupled to the frame 12, a battery enclosure 20, an aperture 22 through the frame 12, a counterweight assembly 24, and slots 26, 28 directed into the frame 12. The pivotal connection between the cover 18 and the frame 12 can be implemented as including hinges, pins, etc., as typically used in the art. As shown, the cover 18 includes a recess 30 that aligns with the aperture 22 through the frame 12. In some cases, the cover 18 can include a peripheral lip (or slot), which can align with an opposing peripheral slot (or lip) of the frame 12 to provide an interface between the cover 18 and the frame 12. In some configurations, cover 18 can include a peripheral gasket to provide a seal between the cover 18 and the frame 12.

The battery enclosure 20 can include a plurality of batteries 32, which can embody many different forms (e.g., lead acid batteries, lithium ion batteries, etc.). In some embodiments, the batteries 32 are implemented as lithium ion batteries, or other batteries that have a decreased spatial footprint. The battery enclosure 20 can include electrical contacts so as to provide power to the material handling vehicle 10, and can include a charging port to receive an electrical plug to provide external power to charge the batteries.

The aperture 22 is sized or dimensioned to receive the battery enclosure 20 (or other battery pack) that contains the batteries 32 (or a single large monolithic battery in some cases) that provides power to the material handling vehicle. In some cases, the aperture 22 can be considered as a window, and as described above, interfaces with the cover 18, and in particular the recess 30 of the cover 18.

The counterweight assembly 24 can include a counterweight 34, a mounting structure 36, and a counterweight positioning system 38 having a first positioning member 40, a second positioning member 42, and a position adjuster 44. The counterweight 34 can embody many different forms. For example, the counterweight 34 can be structured as a shell containing an internal volume that receives the battery enclosure 20, while in other cases the counterweight 34 can be formed out of a rigid material (e.g., casted metal), which can also have a recess (or cavity) that receives the battery enclosure 20. Thus, the counterweight 34 can be structured as having various sizes, dimensions, shapes, and weights (or masses), but generally includes an internal volume having the mounting structure 36. In some embodiments, the mounting structure 36 is coupled to the counterweight such as with fasteners, adhesives, magnetic couplings, etc., and receives and retains the battery enclosure 20 to and within the counterweight 34. The mounting structure 36 can embody many different forms. For example, the mounting structure 36 can be implemented as a raised strip (or a slot), and the battery enclosure 20 can include a slot (or a raised strip), such that the battery enclosure 20 slidingly engages with the mounting structure 36. The mounting structure 36 can also include a number of fastening locations, such as threaded bores, that allow the battery enclosure 20 to be coupled to the mounting structure 36 with fasteners (e.g., bolts) that threadingly engage the threaded bores. In some configurations, the mounting structure 36 can be implemented as the counterweight assembly (e.g., the counterweight assemblies 108, 208, 408, etc.) described in U.S. Patent Application Publication 2020/0047630, also owned by The Raymond Corporation, which is hereby incorporated by reference herein in its entirety for all purposes. Correspondingly the battery enclosure 20 can also be implemented as the battery assemblies (e.g., the battery assemblies 102, 202, 302, 402, etc.) as also described in U.S. Patent Application Publication 2020/0047630. Thus, in some configurations the mounting structure 36, or the battery enclosure 20 can include roller bearings, which can allow a sliding interface between these components. Additionally, retaining structures, such as fasteners, plates, etc., can be installed to retain the battery enclosure 20 on the mounting structure 36.

In some configurations, the mounting structure 36 need not be a separate component to the counterweight 34. For example, in some embodiments, the mounting structure 36 is integrally formed with the counterweight 34, such as a slot, or a raised strip directed into or protruding from the counterweight 34.

As shown in FIG. 5, the counterweight positioning system 38 can be located within the internal volume of the counterweight 34. More specifically, the counterweight positioning system 38 can include the first positioning member 40 extending through and moveably through the counterweight 34, the second positioning member 42 extending through and movably through the counterweight 34, and the position adjuster 44 are located within a lower recess of the counterweight 34. However, in alternative embodiments the counterweight positioning system 38 can be located in different areas of the counterweight 34. Although, in this configuration, the slots 26, 28 may still be incorporated to receive the first positioning member 40, and the second positioning member 42 respectively. Thus, in some cases, to achieve this the slots 26, 28 can be collinear with the positioning members 40, 42 and each other.

In some embodiments, the counterweight positioning system 38 allows for translational movement of the counterweight 34. More specifically, the counterweight positioning system 38, and the location of the slots 26, 28 in the frame 12 determine which translational direction the counterweight 34 moves in. For example, as illustrated in FIG. 5, slots 26, 28 are directed into the frame 12 in a rearward, and frontward direction relative to the direction of the material handling vehicle 10. In particular, slot 26 is directed into the frame 12 towards the forks 14, whereas slot 28 is directed into the frame 12 away from the forks 14. As described below, this allows for movement of the counterweight 34 in a rearward or frontward direction, or toward or away from the forks 14. To adjust the position of the counterweight 34, the position adjuster 44 either advances or retreats the first positioning member 40, or the second positioning member 42, or both. This changes how far (or the distance) each (or one of) the positioning members 40, 42 emerges from the counterweight 34, which thereby determines how the counterweight 34 is positioned. For example, if the counterweight 34 was desired to be moved in a rearward direction, the second positioning member 42 would be retreated by the position adjuster 44, and the first positioning member 40 would be extended by the position adjuster 44. Similarly, if the counterweight 34 was desired to be moved in a frontward direction, the first positioning member 40 would be retreated by the position adjuster 44, and the second positioning member 42 would be extended by the position adjuster 44. Generally, because the mounting structure 36 is coupled to the counterweight 34, movement of the counterweight 34 also moves the mounting structure 36.

As shown in FIG. 5, regardless of the length of the positioning members 40, 42 (up until a certain point) the positioning members 40, 42 can be received in the entire respective slot (e.g., slots 26, 28). This way, the engagement surface between a positioning member and a respective slot is maximized, and does not have to be decreased even if the counterweight is to be moved, and the positioning members are retracted. In other words, the engagement between the slots and the positioning members are not impacted (or are independent) of the position of the counterweight 34. This allows the counterweight 34 to be stable relative to the frame 12 even if the counterweight 34 needs to be adjusted.

The slots 26, 28 and corresponding positioning members 40, 42 share the same shape. However, this shape can embody many different forms, such as prisms (e.g., rectangular prisms, triangular prisms, octagonal prisms, etc.), cylinders, etc. In some cases, the slots 26, 28 and the positioning members 40, 42 are implemented as rectangular prisms, which in some cases, may prevent rotation of the positioning members 40, 42 when the positioning members 40, 42 are received in their respective slots.

In some embodiments, the position adjuster 44 can be implemented with hydraulic or electrical actuators (e.g., linear actuators) to advance and retract the positioning members 40, 42. In other embodiments, the position adjuster 44 can be implemented with mechanical components aimed to cause advancement or retraction of the positioning members 40, 42. In one example, the positioning members 40, 42 can be threaded, and the position adjuster 44 can include a first nut that threadingly engages with the positioning member 40, and a second nut that engages with the positioning member 42. This way, depending on how the first and second nuts are rotated (e.g., the rotational direction, and the handedness of the threading), the positioning members 40, 42 can be retracted and advanced accordingly. In another example, the positioning member 40 can be threaded (such as right handed), and the positioning member 42 can be threaded opposite to the poisoning member 40 (such as left handed). An adjusting shaft can have a hole directed therethrough with a first portion having right handed threading and a second portion having left handed threading, each portion of the adjusting shaft respectively engaging with the corresponding threaded portion of the positioning members 40, 42. This way, when the adjusting shaft is rotated in a first direction, the positioning member 40 retracts, while the positioning member 42 advances (or vice versa).

As yet another example, the positioning members 40, 42 can include wedged (or sloped) regions that interface with a wedge or corresponding wedges. The position of the wedge (or wedges) can be adjusted (e.g., with a fastener and a nut) to slide the wedged regions of the positioning members 40, 42 relative to the corresponding wedge (or wedges) thereby adjusting the retraction or advancement of the positioning members 40, 42. In a still further example, the positioning members 40, 42 can be connected to a linkage assembly (or linkage assemblies) that have multiple pivotal linkages. The position of the linkage assembly (or assemblies) can be adjusted by (e.g., with a fastener and a nut) advancing or retreating the linkage assembly thereby also adjusting or retreating the corresponding positioning members 40, 42 (e.g., linkage assembly pulling or pushing the positioning members 40, 42. In yet another example, the positioning members 40, 42 can have channels that allow for different fastening locations, where differing fastening locations allow for different amounts that the positioning members 40, 42 extend from the counterweight 34 thereby adjusting the position of the counterweight 34.

As shown in FIG. 5, the counterweight 34 is positioned such that the mounting structure 36 is not yet aligned with the aperture 22 (or window) of the frame 12 (e.g., preventing insertion of the battery enclosure 20, and the cover 18 contacts the counterweight 34 (e.g., the counterweight 34 prevents the cover 18 from closing). In order to close the cover 18, and to move the mounting structure 36, the counterweight 34 should be moved rearwardly by retracting the second positioning member 42 and advancing the first positioning member 40 (e.g., via the position adjuster 44).

Figure 6:
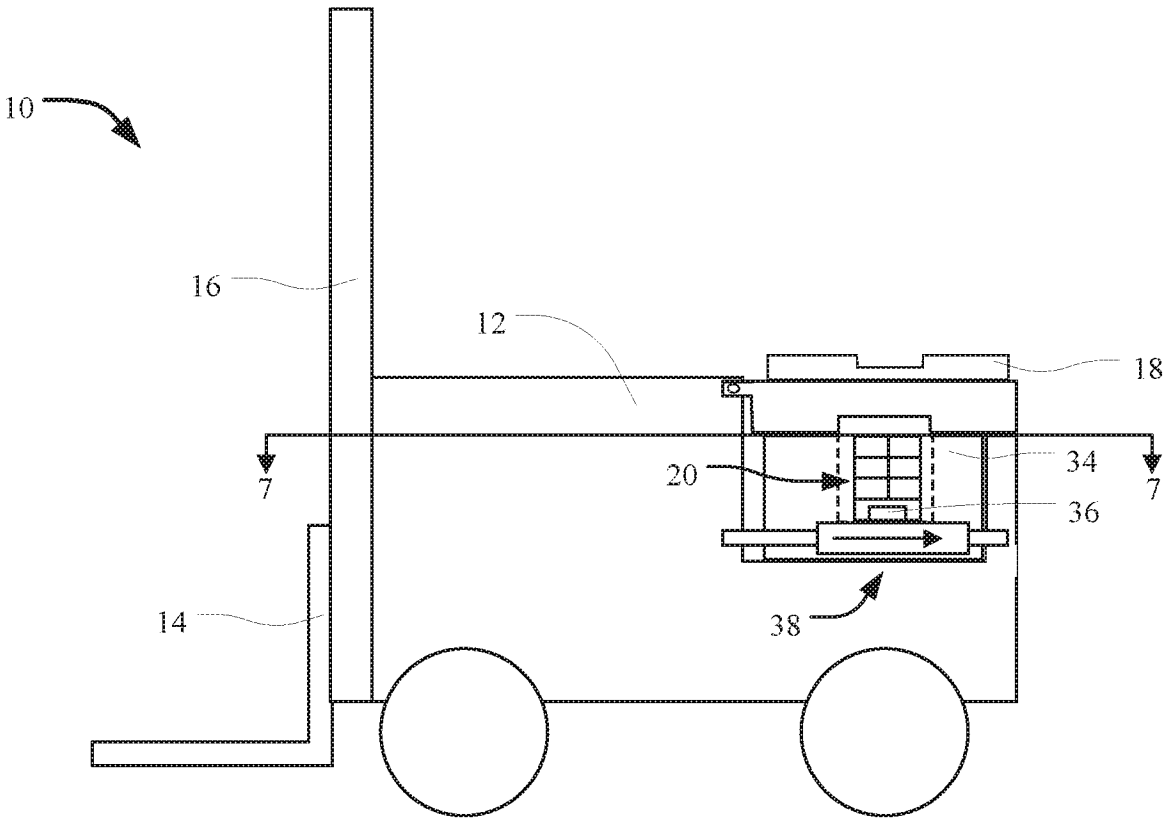
FIG. 6 shows an illustration of the material handling vehicle of FIG. 5, after movement of the counterweight.

FIG. 6 shows another illustration of the material handling vehicle 10, after the counterweight 34 has been moved rearwardly by adjustment by the counterweight positioning system 38. As shown in FIG. 6, after movement of the counterweight 34 rearwardly, the mounting structure 36 is now in alignment with the aperture 22 (or window) of the frame 12, and the counterweight 34 has been moved to allow the cover 18 to close.

Figure 7:
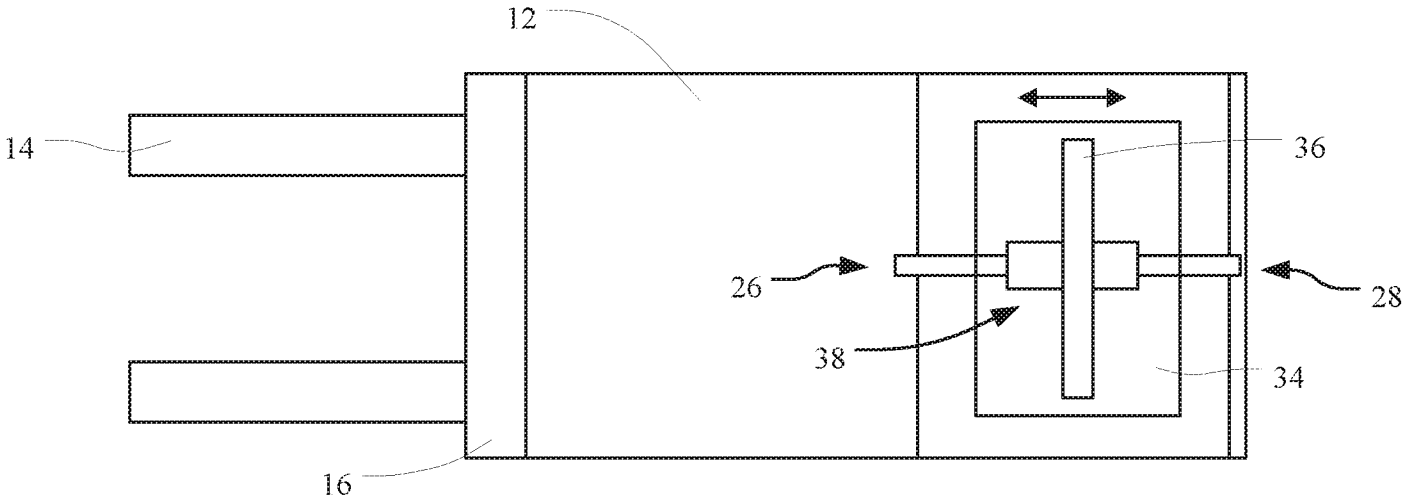
FIG. 7 shows a top cross-sectional view of the material handling vehicle of FIG. 5, taken along the line 7-7 of FIG. 6.

FIG. 7 shows a cross-sectional view of the material handling vehicle 10, taken along line 7-7 of FIG. 6, with the battery enclosure 20 removed for visual clarity. The top-view cross-sectional view of FIG. 7 shows the transverse positioning of the counterweight positioning system 38, where the counterweight positioning system 38 is superimposed along the longitudinal axis of the material handling vehicle 10. Additionally, the mounting structure 36 is positioned above at least a portion of the counterweight 34. Although only one counterweight positioning system 38 is shown in the illustrated embodiment, in alternative embodiments, each counterweight assembly 24 can include multiple counterweight positioning systems 38 (e.g., two, three, etc.), with corresponding slots directed into the frame. This way, with multiple counterweight positioning systems, the counterweight 34 may adjustable in more than one way relative to the frame 12.

Figure 8:
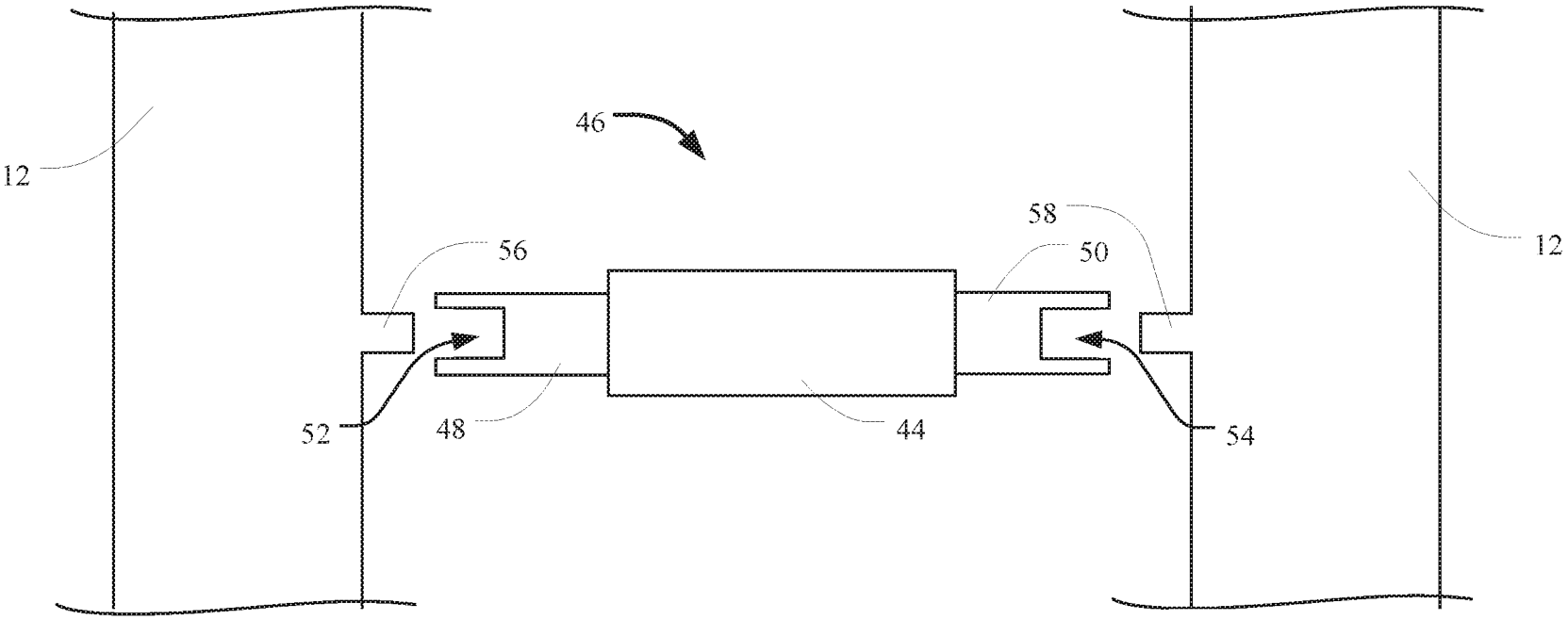
FIG. 8 shows an example of a counterweight positioning system for a counterweight of a material handling vehicle.

FIG. 8 shows an alternative embodiment of a counterweight positioning system 46, which can be substituted for any counterweight positioning system (e.g., the counterweight positioning system 38). The counterweight positioning system 46 includes a first positioning member 48, and a second positioning member 50, which each having a respective recess 52, 54. Additionally, the frame 12, rather than having slots 26, 28, have protrusions 56, 58 emanating from the frame 12, which are substantially aligned with the recesses 52, 54 (e.g., being collinear). The position adjuster 44 advances or retreats (as described in detail above) the first positioning member 48 and the second positioning member 50 to adjust the position of the counterweight 34 (not shown interfacing with the counterweight positioning system 46). To provide stability, the protrusion 56 is directed and nests into the recess 52 of the first positioning member 48. Similarly, the protrusion 58 is directed and nests into the recess 54 of the second positioning member 50. As with the previous description of the shapes of the slots 26, 28, and the positioning members 40, 42, the corresponding recesses and protrusions also share the same shape, but can be embodied in many different forms, such as prisms (e.g., rectangular prisms, triangular prisms, octagonal prisms, etc.), cylinders, etc. The structures of the counterweight positioning system 46 can be substituted for components of other counterweight positioning systems. For example, rather than slots directed into the frame, the frame can include protrusions, and thus the positioning members (or other similar components) can include a recess.

Regarding FIGS. 5-8, although the counterweight positioning systems 38, 46 are illustrated as interfacing with slots directed into, and protrusions protruding from, the material handling vehicle frame (respectively), in alternative embodiments, the slots, or protrusions can be omitted, as these are optional for moving the counterweight. For example, with the slots, and protrusions omitted, the counterweight positioning system 38 can advance the positioning members 40, 42 until they contact the frame 12 to secure the positon of the counterweight 34 (relative to the frame 12). Similarly, the counterweight positioning system 46 can advance the positioning members 48, 50 until they contact the frame 12 to secure the position of the counterweight 34 (relative to the frame 12).

Figure 9:
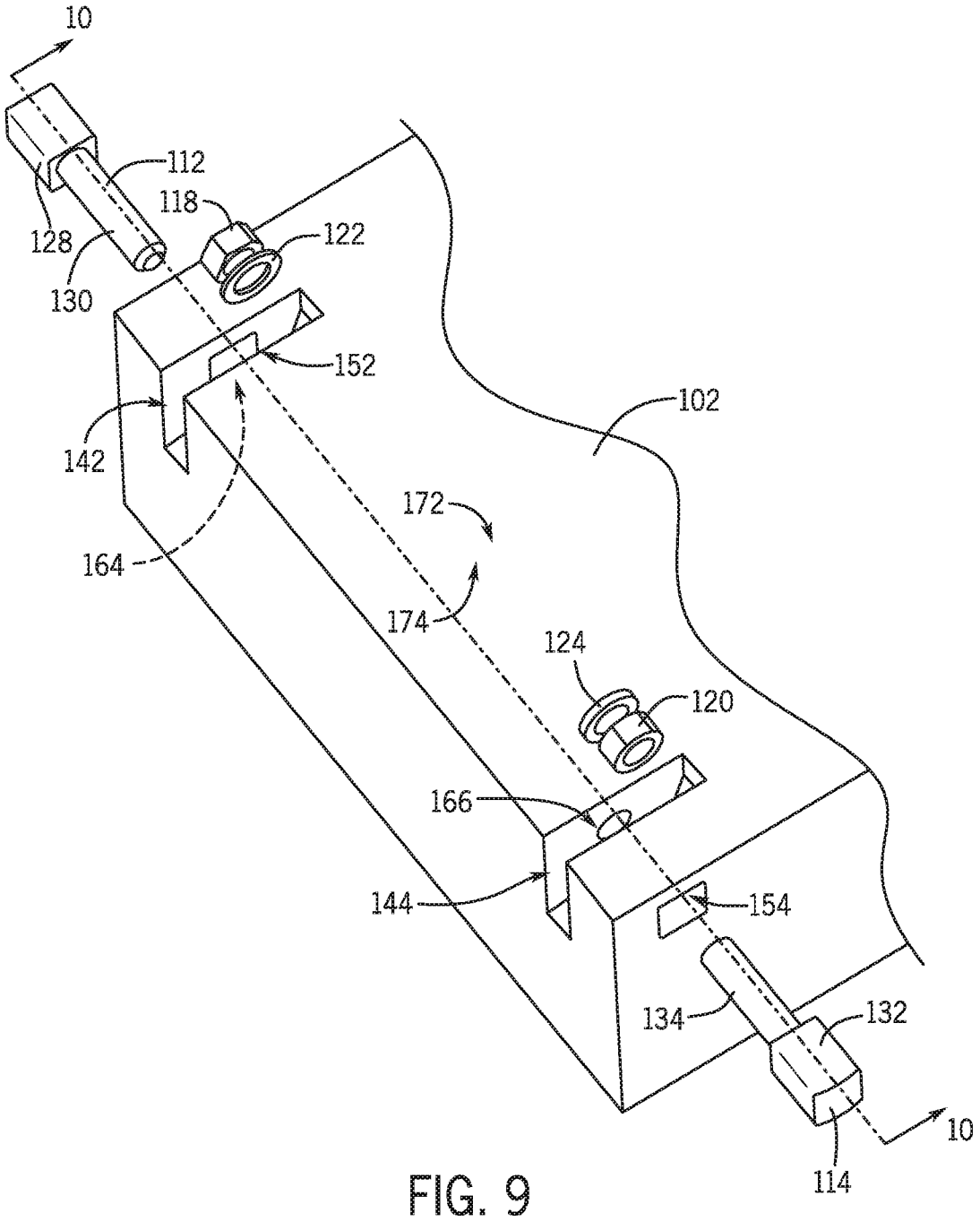
FIG. 9 shows a top perspective view of a counterweight assembly.

FIG. 9 shows a top perspective view of an example of a counterweight assembly 100. As shown, the counterweight assembly 100 includes a counterweight 102, and a counterweight positioning system 104 having a first positioning rod 112, a second positioning rod 114, a first nut 118, a second nut 120, a first washer 122, and a second washer 124. The first positioning rod 112 and the second positioning rod 114 are substantially identical, the first nut 118 and the second nut 120 are substantially identical, and the first washer 122 and the second washer 124 are substantially identical, however in alternative embodiments, different sizes (e.g., lengths, radii, etc.) can be implemented appropriately. As shown, the first positioning rod 112 includes a first end 128 and a second end 130, and the second positioning rod 114 includes a third end 132 and a fourth end 134. In some cases, such as illustrated the second end 130 is narrower (e.g., smaller in cross-sectional area) than the first end 128. The first end 128 is non-circular (e.g., square, rectangular, polygonal, ovate, ovular, etc.) in cross-section, while the second end 130 is generally round in cross-section and is threaded. In some cases, the fourth end 134 is narrower than the third end 132. The third end 132 is non-circular in cross-section (e.g., illustrated as being substantially square), while the fourth end 134 is generally round in cross-section and is threaded. As shown in FIG. 9, the edges of the first end 128, and the third end 132 are slightly rounded (e.g., being beveled, chamfered, etc.).

In some embodiments, the counterweight 102 includes a first cavity 142, a second cavity 144, a first opening 152, a second opening 154, a first well 164, and a second well 166. The first opening 152 and the first well 164 are generally transverse and are in communication with the first cavity 142. The first opening 152 is noncircular and corresponds in shape to the first end 128, although in alternative embodiments the first opening 152 and the first end 128 could be circular in shape. The first well 164 is round and corresponds in shape to the shape of the second end 130. The second opening 154 and the second well 166 are generally transverse and are in communication with the second cavity 144. The second opening 154 is noncircular and corresponds to the third end 132 although in alternative embodiments the second opening 154 and the first end 128 could be circular in shape. The second well 166 is also round and corresponds in shape to the shape of the fourth end 134. The first opening 152, the first cavity 142, and the first well 164 are mirror images of the second opening 154, the second cavity 144, and the second well 166. Thus, the openings 152, 154 are substantially similar, the cavities 142, 144 are substantially similar, and the wells 164, 166 are substantially similar.

Figure 10:
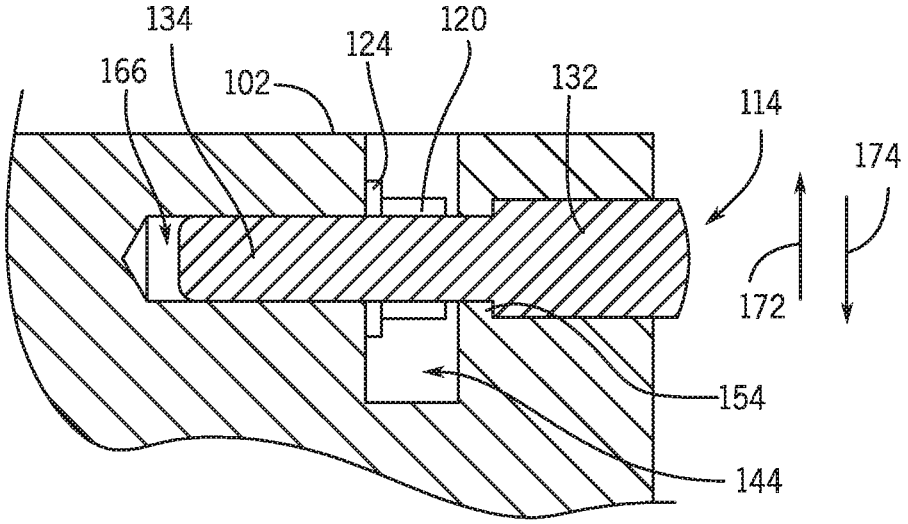
FIG. 10 shows a cross-sectional view of the counterweight assembly of FIG. 1 taken along line 10-10 of FIG. 9.

FIG. 10 shows a side cross-sectional view of the counterweight assembly 100 taken along line 10-10 of FIG. 9. As shown in FIG. 10, the second opening 154 and the second well 166 are generally collinear. The second positioning rod 114 is slidably engaged with the counterweight 102, and the fourth end 134 of the second positioning rod 114 is positioned within the second well 166, whereas the third end 132 is positioned within and extends through the second opening 154 and past the counterweight 102. The second washer 124 and the second nut 120 are positioned in the second cavity 144, where the second nut 120 is threadingly engaged with the fourth end 134 of the second positioning rod 114. It should be understood that the first positioning rod 112, the first nut 118, and the first washer 122 are engaged with one another and the counterweight 102 via the first opening 152, the first cavity 142, and the first well 164 in the same manner that the second positioning rod 114, the second nut 120, and the second washer 124 are engaged with one another and the counterweight 102 via the second opening 154, the second cavity 144, and the second well 166.

When the position of the counterweight 102 is to be moved via the counterweight positioning system 104, the first nut 118 is rotated in either of the directions 172, 174 depending on the handedness of the threading to slidably extend the first positioning rod 112 outwardly and past the counterweight 102. Similarly, when the first nut 118 is rotated in the opposing direction, the first positioning rod 112 slidably retracts inwardly into the counterweight 102. The same operation is completed for the second nut 120 and the second positioning rod 114. For example, depending on the handedness of the threading the second nut 120 is rotated in either of the direction 172, 174 to slidably extend the second positioning rod 114 outwardly past the counterweight 102. Similarly, when the second nut 120 is rotated in the opposing direction, the second positioning rod 114 slidably retracts inwardly into the counterweight 102.

Figure 11:
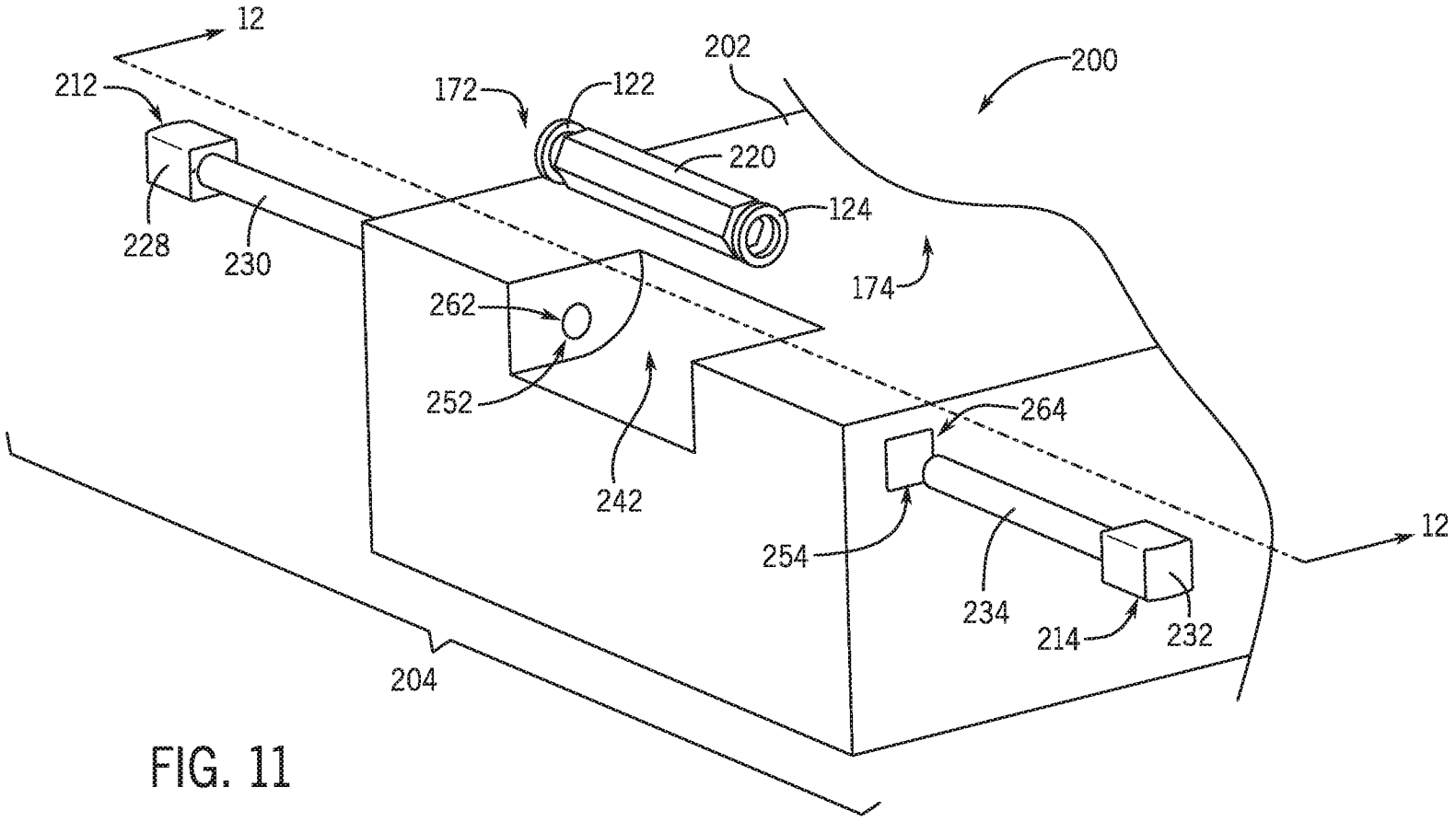
FIG. 11 shows a perspective view of another counterweight assembly.

FIG. 11 shows a top perspective view of an example of a counterweight assembly 200. As shown, the counterweight assembly 200 includes a counterweight 202, and a counterweight positioning system 204 having a first positioning rod 212, a second positioning rod 214, an adjusting shaft 220, the first washer 122, and the second washer 124. In some embodiments, the first positioning rod 212 includes a first end 228 and a second end 230, and the second positioning rod 214 includes a third end 232 and a fourth end 234. The second end 230 is narrower (e.g., smaller in cross-sectional area) than the first end 228. In some embodiments, the first end 228 is non-circular (e.g., square, rectangular, polygonal, ovate, ovular, etc.) in cross-section, while the second end 230 is generally round in cross-section and is threaded. The fourth end 234 is narrower than the third end 232. In some cases, the third end 232 is non-circular in cross-section, while the fourth end 234 is generally round in cross-section and is threaded. Importantly, the second end 230 and the fourth end 234 are oppositely externally threaded (e.g., the second end 230 has left handed threads, and the fourth end 234 has right handed threads). In some embodiments, the counterweight 202 includes a cavity 242, a first opening 252, and a second opening 254, where the first opening 252 and the second opening 254 are in communication with the cavity 242.

Figure 12:
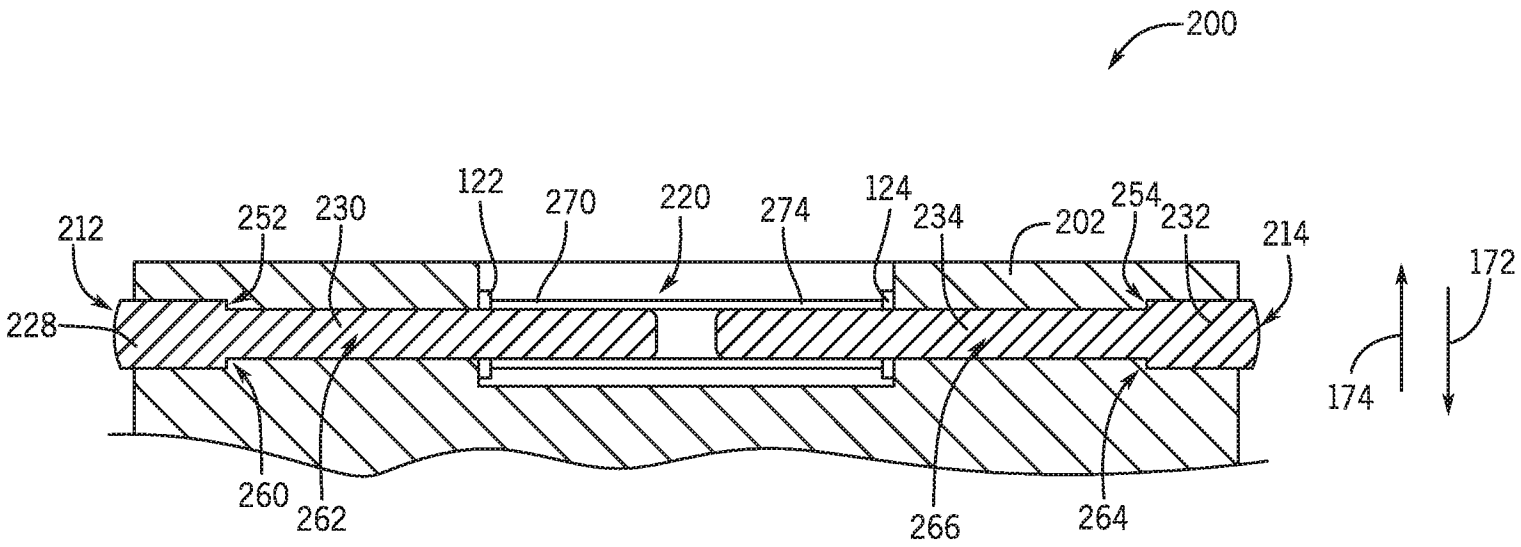
FIG. 12 shows a cross-sectional view of the counterweight assembly of FIG. 11 taken along line 12-12 of FIG. 11.

FIG. 12 shows a cross-sectional view of the counterweight assembly 200 taken along line 12-12 of FIG. 11. As shown, the first opening 252 and the second opening are mirror images of one another. The first opening 252 has a first noncircular portion 260 and a first round portion 262, while the second opening 254 has second noncircular portion 264 and a second round portion 266. The first noncircular portion 260 corresponds in shape to the shape of the first end 228, and the second noncircular portion 264 corresponds in shape to the shape of the third end 232. The first round portion 262 corresponds in shape to the second end 230, and the second round portion corresponds in shape to the fourth end 234. Although the openings 252, 254 and corresponding rods 212, 214 are described and shown with specific shapes (e.g., circular, and square in cross-section), in alternative embodiments different shapes are contemplated.

As shown in FIG. 12, the first positioning rod 212 is slidably disposed in the first opening 252, with the first end 228 slidably disposed in the first noncircular portion 260, and with the second end 230 slidably disposed in the first round portion 262. Similarly, the third end 232 is slidably disposed in the second noncircular portion 264, and the fourth end 234 is slidably disposed in the second round portion 266.

Referring to FIGS. 11 and 12, the adjusting shaft 220 is generally tubular having a hole directed therethrough. The adjusting shaft 220 is internally threaded, having different threaded regions, while the external shape of the adjusting shaft 220 is noncircular (e.g., being hexagonal for engagement with a tool, such as a wrench). As shown, the adjusting shaft 220 has a first portion 270 having threads of a first direction (e.g., threads that are left handed), and the adjusting shaft 270 has an opposite second portion 274 having threads of a second direction, opposite the first (e.g., threads that are right handed). Thus, the threads of the first portion 270 and the second portion 274 are oppositely threaded, and are configured to threadingly engage with the second end 230, and the fourth end 234 respectively. In some embodiments, and as illustrated the adjusting shaft 220 is disposed in the cavity 242, and the first washer 122 is disposed in the cavity 242 between the adjusting shaft 220 and the counterweight 202. Similarly, the second washer 124 is disposed in the cavity 242 between the adjusting shaft 220 and the counterweight 202.

When the position of the counterweight 202 is to be moved via the counterweight positioning system 204, the adjusting shaft 220 is rotated in the first direction 172, which retracts the second positioning rod 214, while extending the first positioning rod 212, ultimately moving the counterweight 202 rightwardly relative to the view in FIG. 12 (or otherwise rearwardly). Similarly, the adjusting shaft 220 can be rotated in the second direction 174, which advances the second positioning rod 214, and retracts the first positioning rod 212, ultimately moving the counterweight 202 leftwardly relative to the view in FIG. 12 (or otherwise frontward). Importantly, the opposing handedness of the threading allows for easier positioning of the counterweight 202. For example, the adjusting shaft 220 needs only to be rotated in one direction to adjust the position of the counterweight 202, whereas both nuts 118, 120 must be individually rotated to adjust the position of the counterweight 102.

Figure 13:
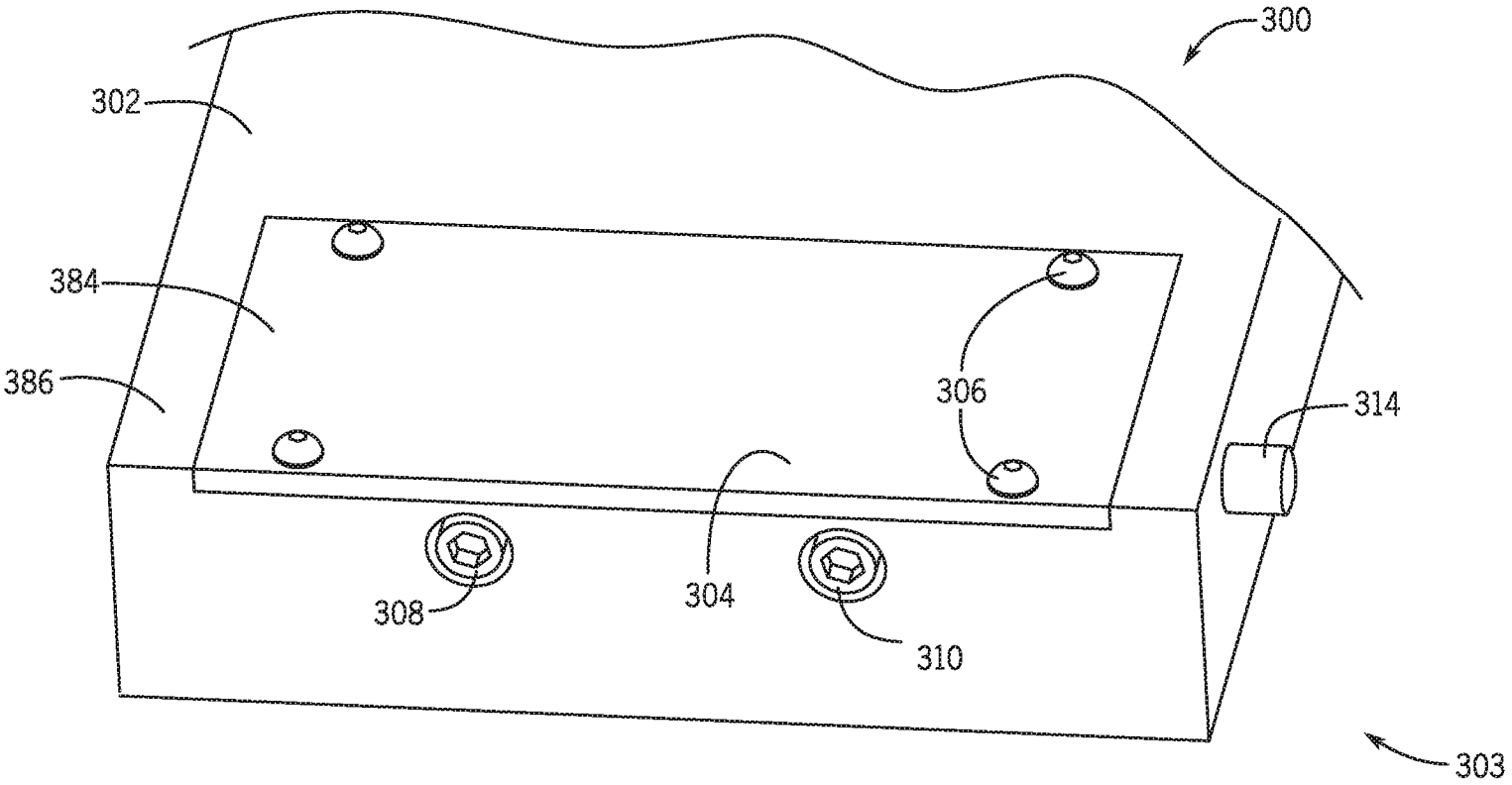
FIG. 13 shows a perspective view another counterweight assembly.

FIG. 13 shows a top perspective view of a counterweight assembly 300. The counterweight assembly 300 includes a counterweight 302, a counterweight positioning system 303 having a cover 304, fasteners 306, a first adjustment screw 308, a second adjustment screw 310, a first positioning rod 312, a second positioning rod 314, a third washer 316, a fourth washer 318, a first position adjustment wedge 322, and a second position adjustment wedge 324. In some embodiments, the first positioning rod 312 includes a first shaft portion 328 and a first wedge portion 330. The second positioning rod 314 includes a second shaft portion 332 and a second wedge portion 334.

The counterweight 302 includes a first cavity 342, a second cavity 344, a first opening 348, a second opening 350, a third opening 352, a fourth opening 354, a fifth opening 356, a sixth opening 358, a first chamber 362, a second chamber 364, a first channel 368, a second channel 370, and a recess 374. The first position adjustment wedge 322 includes a seventh opening 378 having threads that threadingly engage the first adjustment screw 308. Similarly, the second position adjustment wedge 324 includes an eighth opening 380 having threads that threadingly engager the second adjustment screw 310. As shown, the first cavity 342 is in communication with the first opening 348, the third opening 352, the fifth opening 356, the first channel 368, the first chamber 362, the seventh opening 378 and the recess 374. The second cavity 344 is in communication with the second opening 350, the fourth opening 354, the sixth opening 358, the second chamber 364, the second channel 370, and the recess 374. In some embodiments, the counterweight has a first top surface 384. The cover 304 has a second top surface 386.

Figure 14:
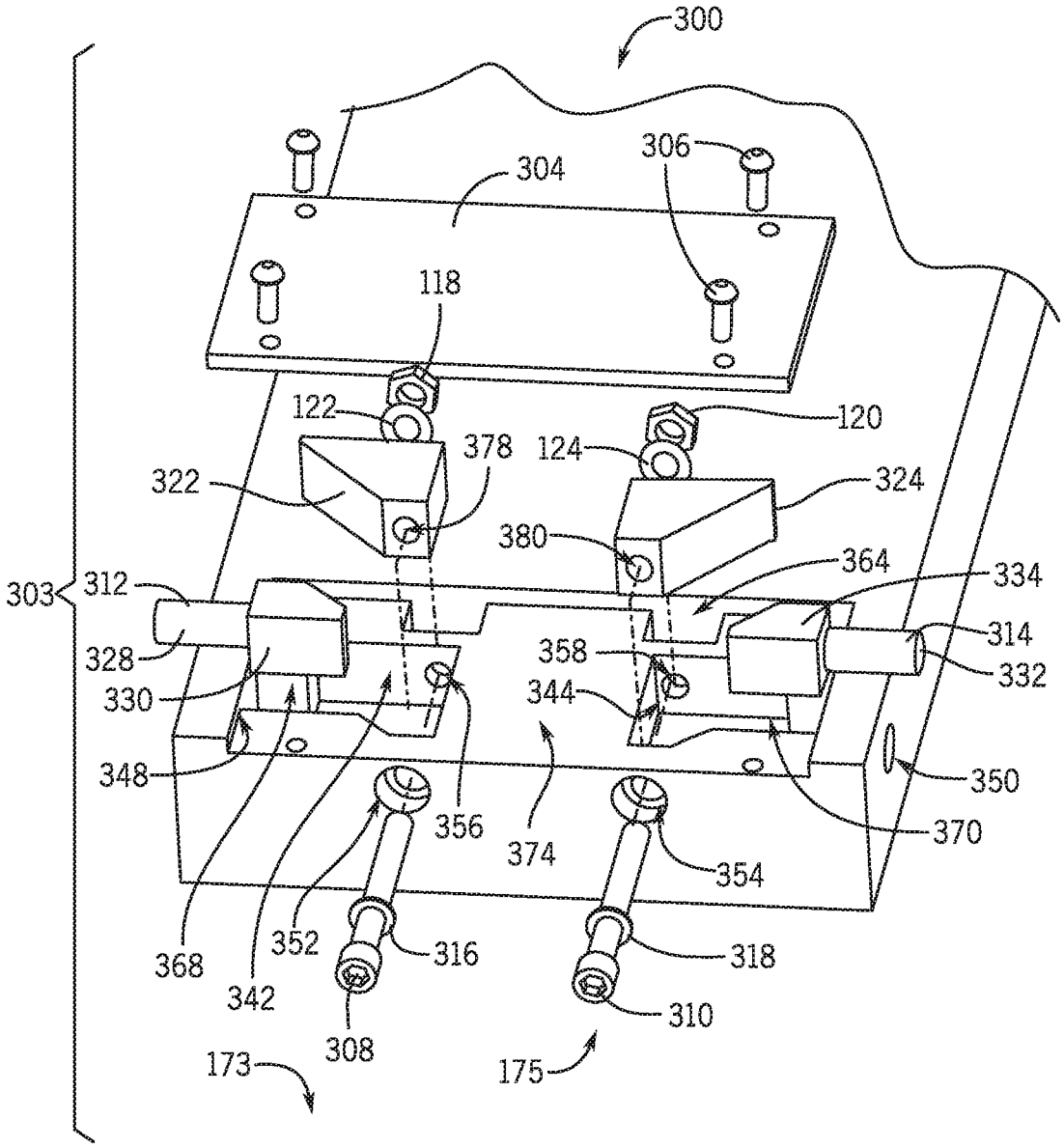
FIG. 14 shows an exploded view of the counterweight assembly of FIG. 13.
Figure 15:
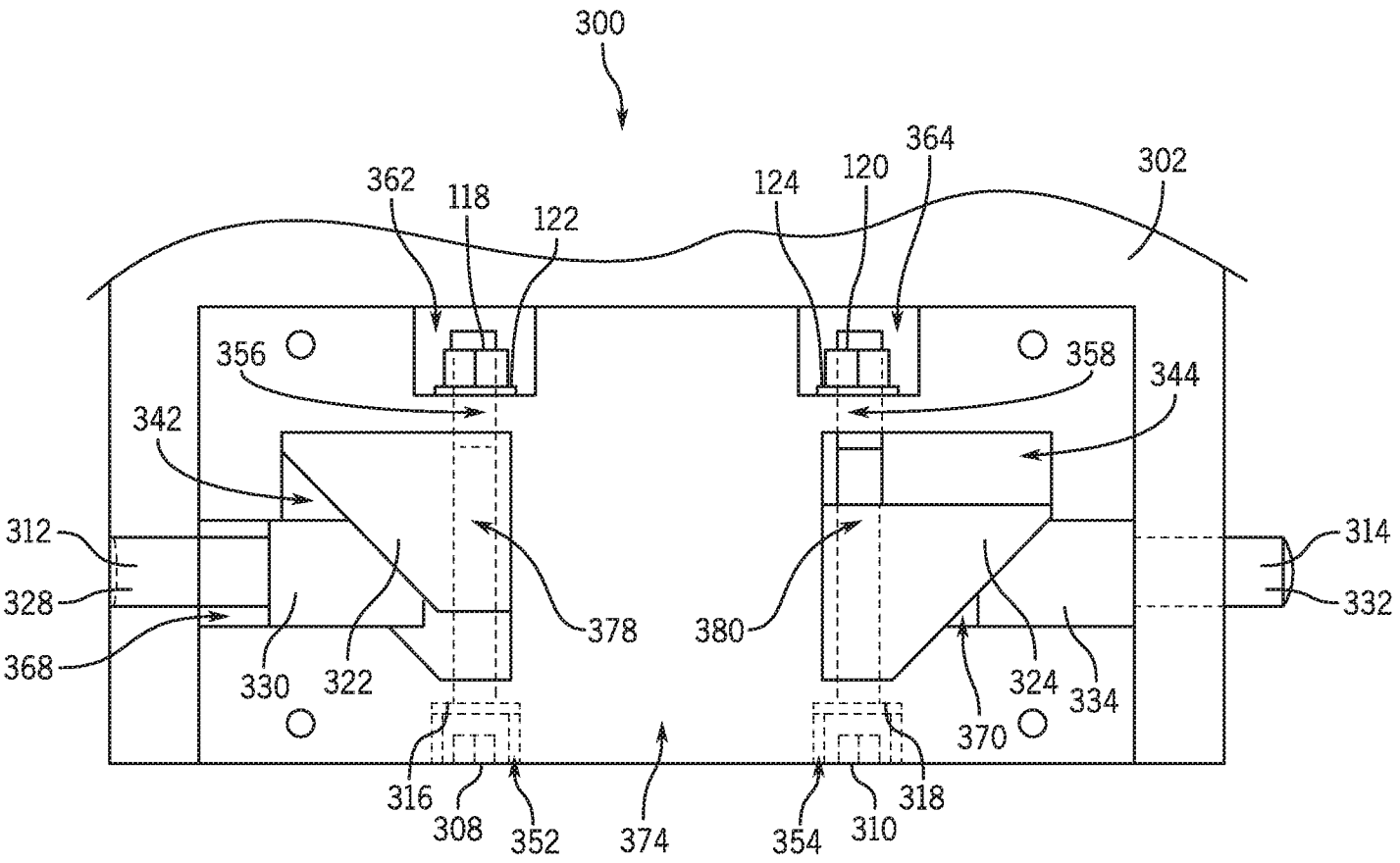
FIG. 15 shows a top view of the counterweight assembly of FIG. 13 with the cover removed.

Referring to FIGS. 13-15, the first positioning rod 312 is slidably disposed in the first cavity 342, the first channel 368, and the first opening 348. The first shaft portion 328 is extendable through the first opening 348. The first wedge portion 330 is partially disposed in the first cavity 342. The first position adjustment wedge 322 is slidably disposed in the first cavity 342. The first position adjustment wedge 322 is slidably engaged with the first wedge portion 330 of the first positioning rod 312. The first position adjustment wedge 322 is threadingly engaged with the first adjustment screw 308. The third washer 316 is disposed in the third opening 352. The first adjustment screw 308 extends through the third opening 352 and the fifth opening 356. The first nut 118 and the first washer 122 are disposed in the first chamber 362. The first nut 118 is threadingly engaged with the first adjustment screw 308.

The second positioning rod 314 is slidably disposed in the second cavity 344, the second channel 370, and the second opening 350. The second shaft portion 332 is extendable through the second opening 350. The second wedge portion 334 is partially disposed in the second cavity 344. The second position adjustment wedge 324 is slidably disposed in the second cavity 344. The second position adjustment wedge 324 is slidably engaged with the second wedge portion 334 of the second positioning rod 314. The second position adjustment wedge 324 is threadingly engaged with the second adjustment screw 310. The fourth washer 318 is disposed in the fourth opening 354. The second adjustment screw 310 extends through the fourth opening 354 and the sixth opening 358. The second nut 120 and the second washer 124 are disposed in the second chamber 364. The second nut 120 is threadingly engaged with the second adjustment screw 310.

When the position of the counterweight 302 is to be moved via the counterweight positioning system 303, the first adjustment screw 308 can rotated in a direction 175 (e.g., loosened) with the first position adjustment wedge 322 rotationally fixed (e.g., by the adjustment wedge 322 contacting the cover 304) thereby advancing the first position adjustment wedge 322 towards the first nut 118 (and the fifth opening 356). As the first position adjustment wedge 322 moves toward the fifth opening 356, the first position adjustment wedge 322 slides away from the first wedge portion 330. Thus, the first shaft portion 328 is free to be pushed back inwardly into the counterweight through the first opening 348 (e.g., by an external force). The first adjustment screw 308 can also be rotated in a direction 173 (e.g., tightened) with the first position adjustment wedge 322 rotationally fixed (e.g., by the first position adjustment wedge 322 contacting the counterweight 302) thereby retreating the first positioning adjustment wedge 322 away from the first nut 118 (and the fifth opening 356), and toward the third opening 352. As the first position adjustment wedge 322 moves toward the third opening 352, the first position adjustment wedge 322 slides against the first wedge portion 330. Thus, the first shaft portion 328 extends outwardly from the counterweight through the first opening 348. The second adjustment screw 310, and the second nut 120 function in a similar manner to the first adjustment screw 308, and the first nut 118. Thus, the previous description of the operation of the first adjustment screw 308 also pertains to the operation of the second adjustment screw 310.

In some embodiments, the fasteners 306 can be threadingly engaged with the counterweight 302 to attach the cover 304 to the counterweight 302. The cover 304 can be disposed in the recess 374 such that the first top surface 384 is generally flush with the second top surface 386. The cover 304, when installed, can allow for the position adjustment wedges 322, 324 to be rotationally fixed so that the wedges 322, 324 can translate appropriately when the corresponding adjustment screw is rotated (e.g., the rotation is blocked to allow translation).

Figure 16:
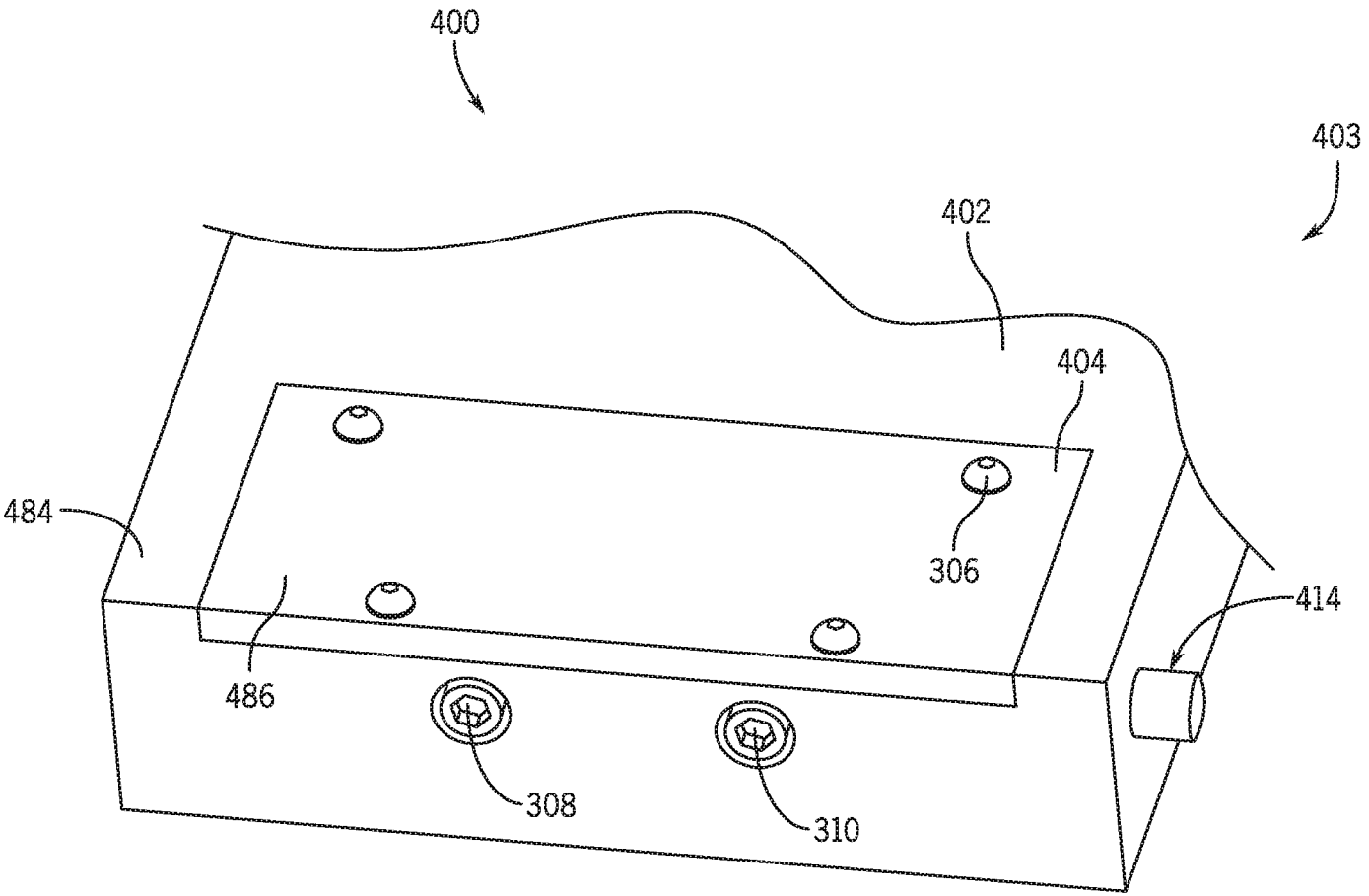
FIG. 16 shows a perspective view of another counterweight assembly.
Figure 17:
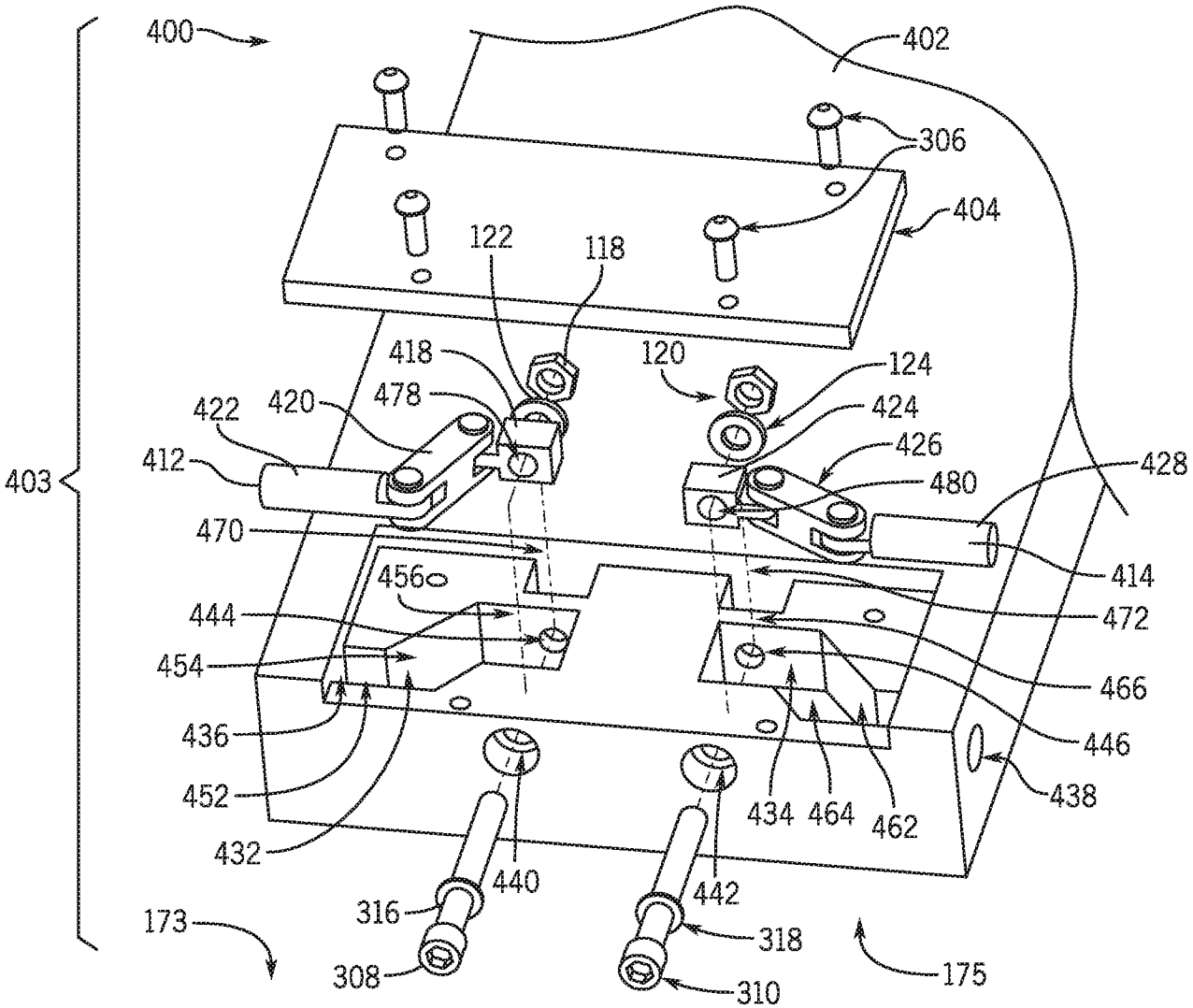
FIG. 17 shows an exploded view of the counterweight assembly of FIG. 16.
Figure 18:
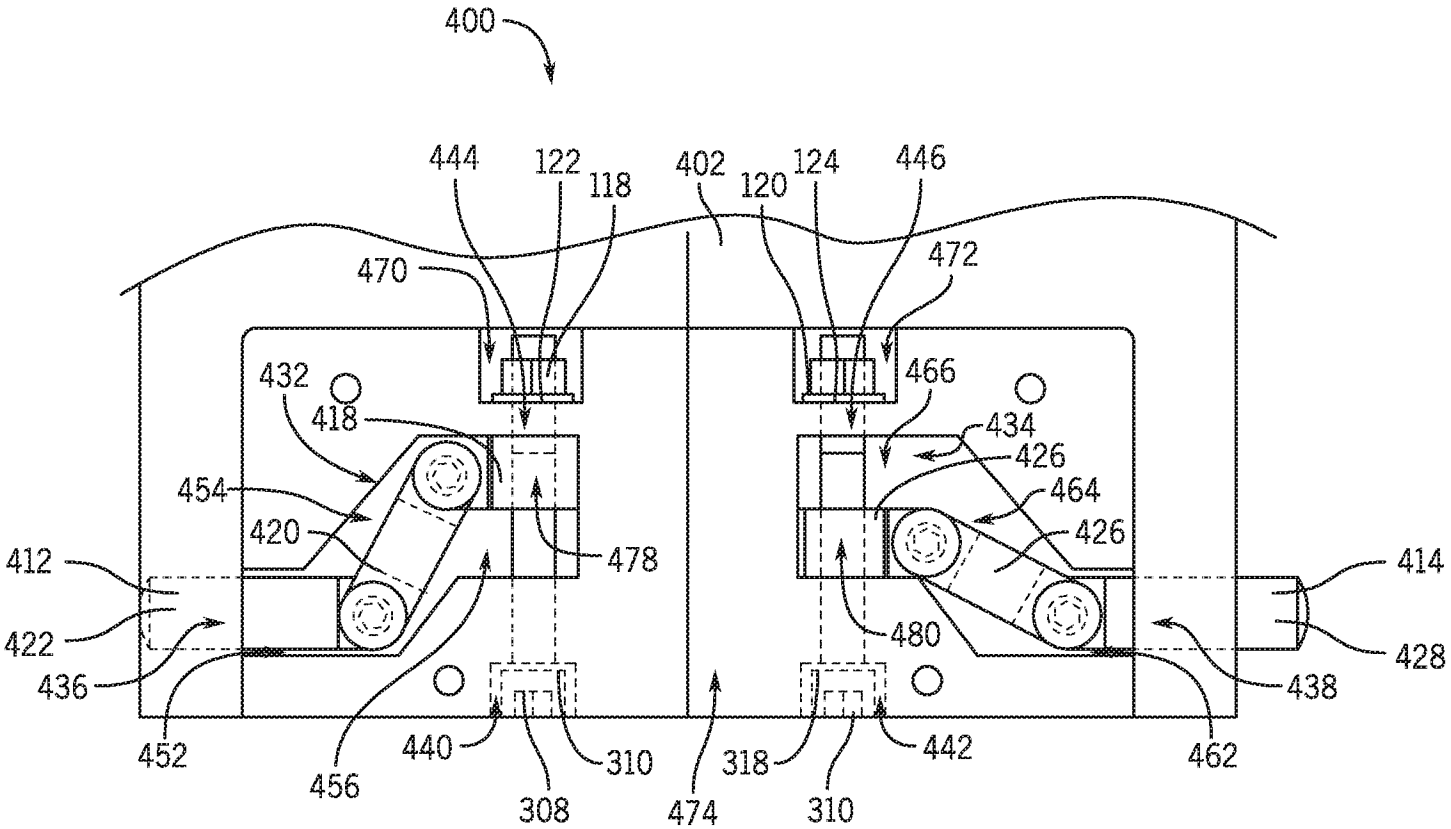
FIG. 18 shows a top view of the fourth example counterweight assembly of FIG. 16 with the cover removed.

FIG. 16 shows a top perspective view of a counterweight assembly 400. The counterweight assembly 400 includes a counterweight 402, and a counterweight positioning system 403 having a cover 404, the fasteners 306, the first adjustment screw 308, the second adjustment screw 310, a first positioning linkage assembly 412, a second positioning linkage assembly 414, the first nut 118, the second nut 120, the first washer 122, the second washer 124, the third washer 316, and the fourth washer 318. The first positioning linkage assembly 412 includes a first position adjustment block 418, a first link 420, and a first positioning rod 422. The second positioning linkage assembly 414 also includes a second position adjustment block 424, a second link 426, and a second positioning rod 428.

As shown, the counterweight 402 includes a first cavity 432, a second cavity 434, a first opening 436, a second opening 438, a third opening 440, a fourth opening 442, a fifth opening 444, and a sixth opening 446. The first cavity 432 includes a first guide channel 452, a first wedge portion 454, and a first drive portion 456. The second cavity includes a second guide channel 462, a second wedge portion 464, and a second drive portion 466. The counterweight 402 also includes a first chamber 470, a second chamber 472, and a recess 474. In some embodiments, the first position adjustment block 418 includes a seventh opening 478 having threads that threadingly engage the first adjustment screw 308. Similarly, the second position adjustment block 424 includes an eighth opening 480 having threads that threadingly engage the second adjustment screw 310. The counterweight 402 has a first top surface 484, and the cover 406 has a second top surface 486.

As shown, the first position adjustment block 418 is pivotally coupled to the first link 420, and the first link 420 is pivotally coupled to the first positioning rod 422. The first adjustment screw 308 extends through the third opening 440, through and threadingly engaged with the first position adjustment block 418, and through the fifth opening 444. The first nut 118 and the first washer 122 are disposed in the first chamber 470, and the first adjustment screw 308 is threadingly engaged with the first nut 118. The first positioning linkage assembly 412 is slidably disposed in the first cavity 432, with the first position adjustment block 418 is disposed in the first drive portion 456, the first link 420 is disposed in the first wedge portion 454, and the first positioning rod 422 is disposed in the first guide channel 452 and is extendable through the first opening 436. The third washer 316 is disposed in the third opening 440.

As shown, the second position adjustment block 424 is pivotally coupled to the second link 426, and the second link 426 is pivotally coupled to the second positioning rod 428. The second adjustment screw 310 extends through the fourth opening 442, through and threadingly engaged with the second position adjustment block 424, and through the sixth opening 446. The second nut 120 and the second washer 124 are disposed in the second chamber 472, and the second adjustment screw 310 is threadingly engaged with the second nut 120. The second positioning linkage assembly 414 is slidably disposed in the second cavity 434, with the second position adjustment block 424 disposed in the second drive portion 466, and with the second link 426 disposed in the second wedge portion 464. The second positioning rod 428 is disposed in the second guide channel 462 and is extendable through the second opening 438. The fourth washer 318 is disposed in the fourth opening 442.

When the position of the counterweight 402 is to be moved via the counterweight positioning system 403, the first adjustment screw 308 can be rotated in the direction 175 (e.g., loosened) with the first position adjustment block 418 rotationally fixed (e.g., by the first position adjustment block 418 contacting the cover 404) thereby advancing the first position adjustment block 418 toward the fifth opening 444 (and the nut 118). As the first position adjustment block 418 moves toward the fifth opening 444, the first position adjustment block 418 pulls the first link 420, thereby pulling and retreating the first positioning rod 422 back through the first opening 436. In other words, when the first adjustment screw 308 is rotated in the first direction 173, the first positioning linkage assembly 412 articulates inwardly, and thus the first positioning rod 422 retracts inwardly into the counterweight 402 through the first opening 436. The first adjustment screw 308 can also be rotated in the direction 173 (e.g., tightened) with the first adjustment block 418 rotationally fixed (e.g., by the first adjustment block 418 contacting the counterweight 402) thereby retreating the first position adjustment block 418 toward the third opening 440 (and away from the first nut 118). As the first position adjustment block 418 moves toward the third opening 440, the first position adjustment block 418 pushes the first link 420, which pushes the first positioning rod 422. In other words, when the first adjustment screw 308 is rotated in the second direction 175, the first positioning linkage assembly 412 articulates outwardly, and thus the first positioning rod 422 extends outwardly from the counterweight 402 through the first opening 436. The second adjustment screw 310, and the second nut 120 function in a similar manner to the first adjustment screw 308, and the first nut 118. Thus, the previous description of the operation of the first adjustment screw 308 with regard to the counterweight assembly 400 also pertains to the operation of the second adjustment screw 310 with regard to the counterweight assembly 400.

In some embodiments, the fasteners 306 are threadingly engaged with the counterweight 402 to attach the cover 404 to the counterweight 402. The cover 404 is disposed in the recess 474 such that the first top surface 484 is generally flush with the second top surface 486. The cover 404, when installed, can allow for the blocks 418, 424 to be rotationally fixed so that the blocks 418, 424 can translate appropriately when the corresponding adjustment screw is rotated (e.g., the rotation is blocked to allow translation).

Figure 19:
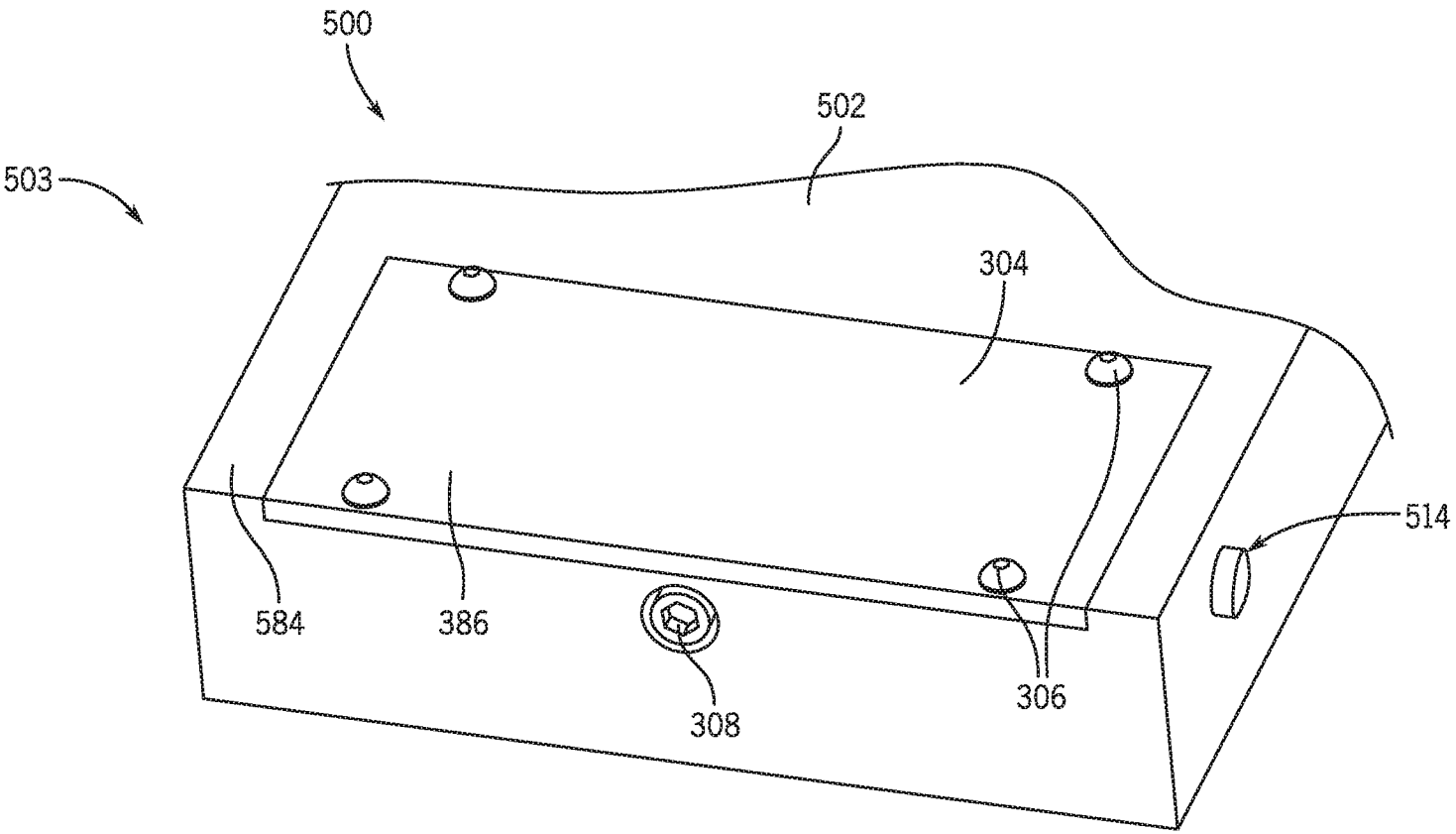
FIG. 19 shows a perspective view of another counterweight assembly.

FIG. 19 shows a top perspective view of a counterweight assembly 500. The counterweight assembly 500 includes a counterweight 502, and a counterweight positioning system 503 having the cover 304, the fasteners 306, the first adjustment screw 308, the first nut 118, the first washer 122, the second washer 124, a first positioning rod 512, a second positioning rod 514, and a position adjustment wedge 518. The first positioning rod 512 includes a first shaft portion 522 and a first wedge portion 524. The second positioning rod 514 includes a second shaft portion 528 and a second wedge portion 530. The position adjustment wedge 518 includes a first sloped side 534 and a second sloped side 536.

In some embodiments, the counterweight 502 includes a cavity 542, a first opening 544, a second opening 546, a third opening 548, and a fourth opening 550. The position adjustment wedge 518 defines a fifth opening 552 having threads that threadingly engage the first adjustment screw 308. The cavity 542 includes a drive portion 556, a first channel 558, and a second channel 560. The counterweight 502 also defines a chamber 564 and a recess 574.

Figure 20:
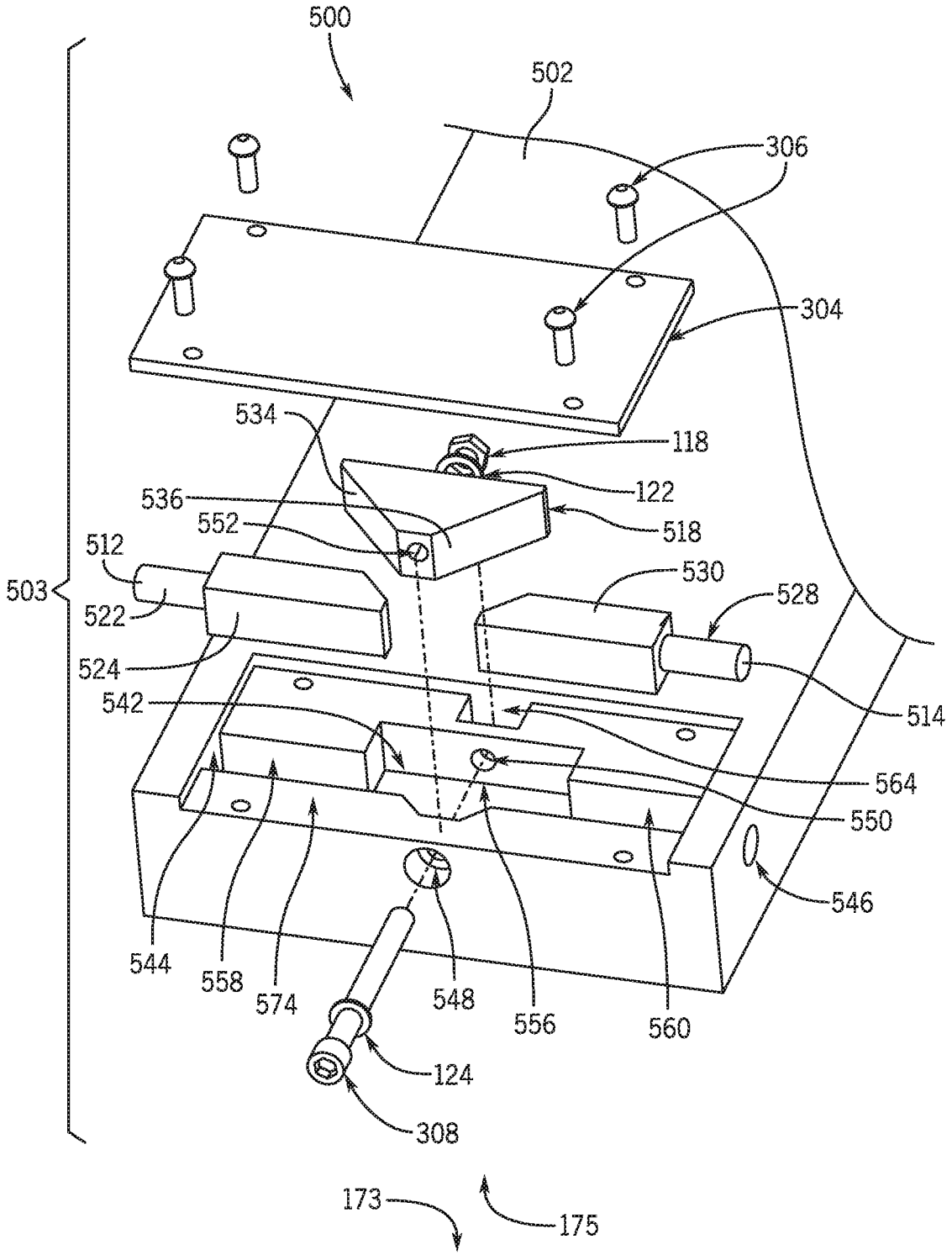
FIG. 20 shows an exploded view of the counterweight assembly of FIG. 19.
Figure 21:
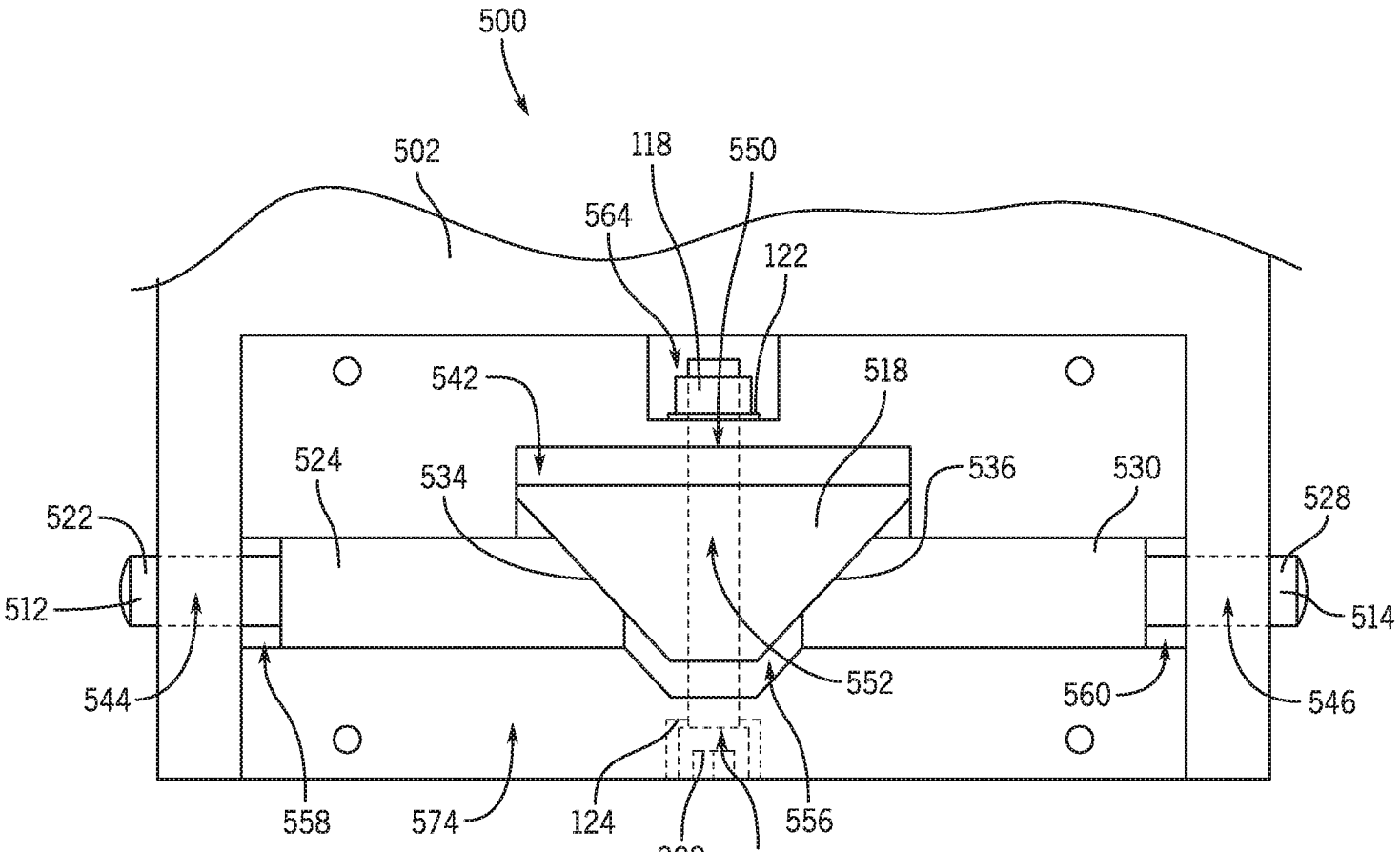
FIG. 21 shows a top view of the counterweight assembly of FIG. 20 with the cover removed.

As shown in FIG. 20, the position adjustment wedge 518 is slidably disposed in the drive portion 556. The first adjustment screw 308 is threadingly engaged with the position adjustment wedge 518. The first adjustment screw 308 extends through the third opening 548, through the position adjustment wedge 518, and into the fourth opening 550. The first adjustment screw 308 is threadingly engaged with the first nut 118. The first nut 118 and the first washer 122 are disposed in the chamber 564. The second washer 124 is disposed in the third opening 548. The first wedge portion 524 is slidably disposed in the first channel 558. The first shaft portion 522 is extendable (and retractable) through the first opening 544. The first wedge portion 524 is slidably engaged with the first sloped side 534. The second wedge portion 530 is slidably disposed in the second channel 560. The second shaft portion 528 is extendable (and retractable) through the second opening 546. The second wedge portion 530 is slidably engaged with the second sloped side 536.

When the position of the counterweight 502 is to be moved via the counterweight positioning system 503, the first adjustment screw 308 can be rotated in the direction 173 (e.g., tightened) with the position adjustment wedge 518 rotationally fixed (e.g., by the position adjustment wedge 518 contacting the counterweight 502) to advance the position adjustment wedge 518 toward the third opening 548. As the position adjustment wedge 518 moves toward the third opening 548, the first sloped side 534 pushes the first wedge portion 524 to further advance the first shaft portion 522 farther through the first opening 544, while the second sloped side 536 pushes the second wedge portion 530 to further advance the second shaft 528 farther through the second opening 546. In other words, when the first adjustment screw 308 is rotated in the direction 173, the first positioning rod 512 and the second positioning rod 514 extend outwardly. The first adjustment screw 308 can also be rotated in the direction 175 (e.g., loosened) with the position adjustment wedge 518 rotationally fixed (e.g., by the position adjustment wedge 518 contacting the cover 304) thereby advancing the position adjustment wedge 518 toward the fourth opening 550. As the position adjustment wedge 518 moves toward the fourth opening 550, the position adjustment wedge 518 moves away from the first positioning rod 512 and the second positioning rod 514. In other words, when the first adjustment screw 308 is rotated in the direction 175, the position adjustment wedge 518 releases the first positioning rod 512 and the second positioning rod 514. Thus, the first positioning rod 512 and the second positioning rod 514 are free to be pushed inwardly back into the counterweight 502 through the first opening 544 and the second opening 546, respectively (e.g., by external forces).

In some embodiments, the fasteners 306 are threadingly engaged with the counterweight 502 to attach the cover 304 to the counterweight 502. The cover 304 is disposed in the recess 574 such that the first top surface 584 is generally flush with the second top surface 386. The cover 304, when installed, can allow for the wedge 518 to be rotationally fixed so that the wedge 518 can translate appropriately when the corresponding adjustment screw is rotated (e.g., the rotation is blocked to allow translation).

Figure 22:
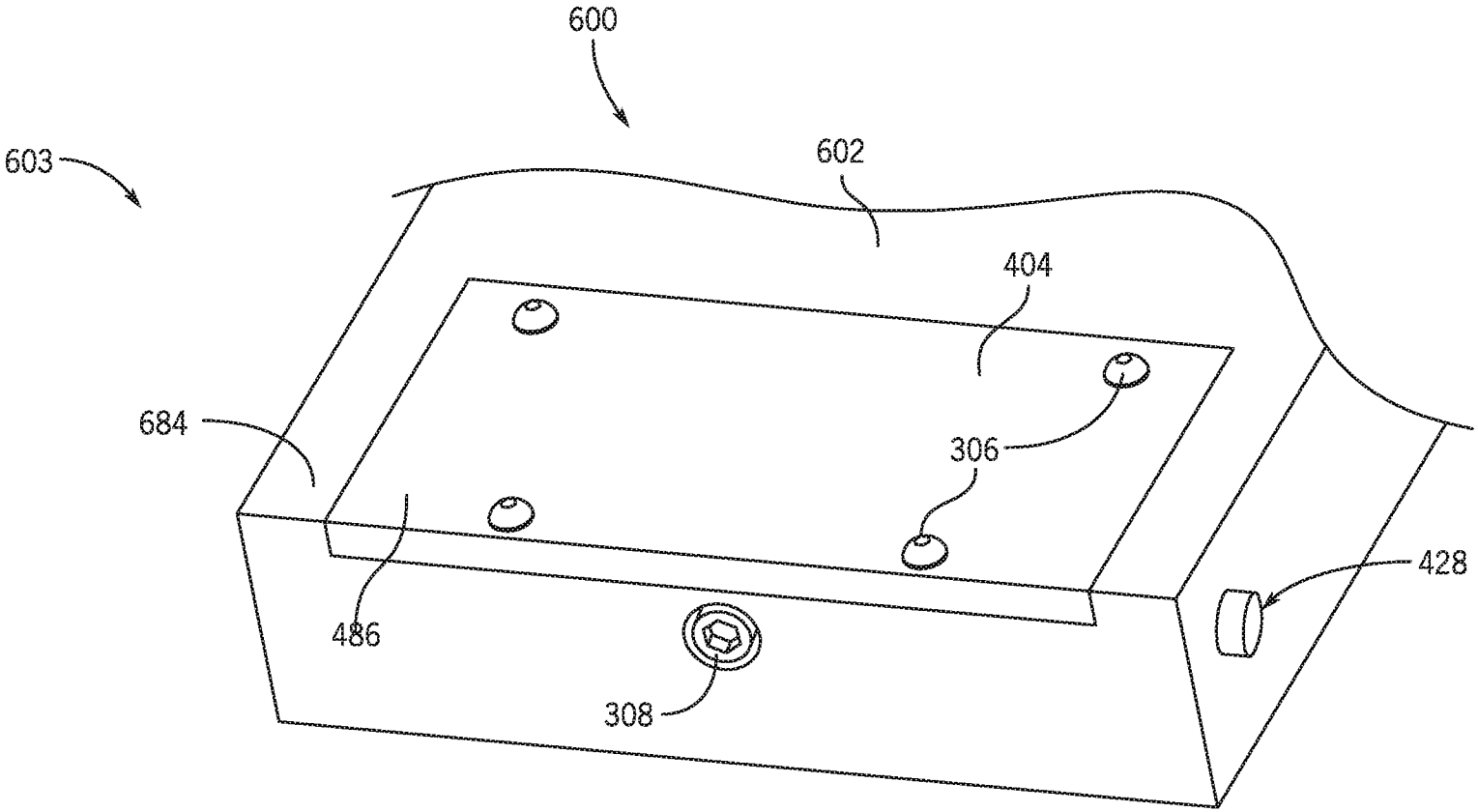
FIG. 22 shows a perspective view of another counterweight assembly.

FIG. 22 shows a front perspective view of a counterweight assembly 600. The counterweight assembly 600 includes a counterweight 602, and a counterweight positioning system 603 having the cover 404, the fasteners 306, the first adjustment screw 308, a positioning linkage assembly 612, the first nut 118, the first washer 122, and the second washer 124. The positioning linkage assembly 612 includes a position adjustment block 618, a first link 620, a second link 622, the first positioning rod 422, and the second positioning rod 428.

Figure 23:
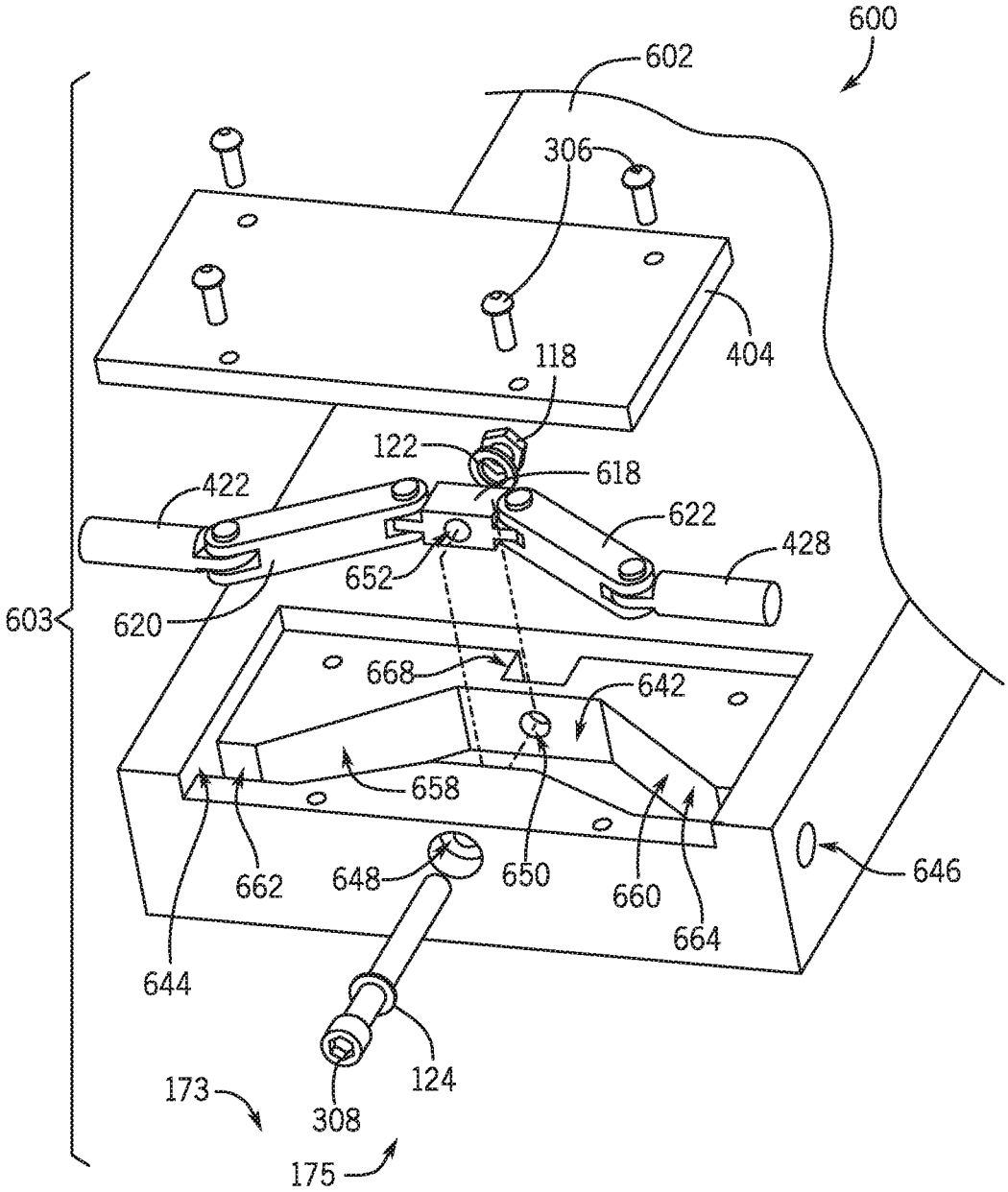
FIG. 23 shows an exploded view of the counterweight assembly of FIG. 22.
Figure 24:
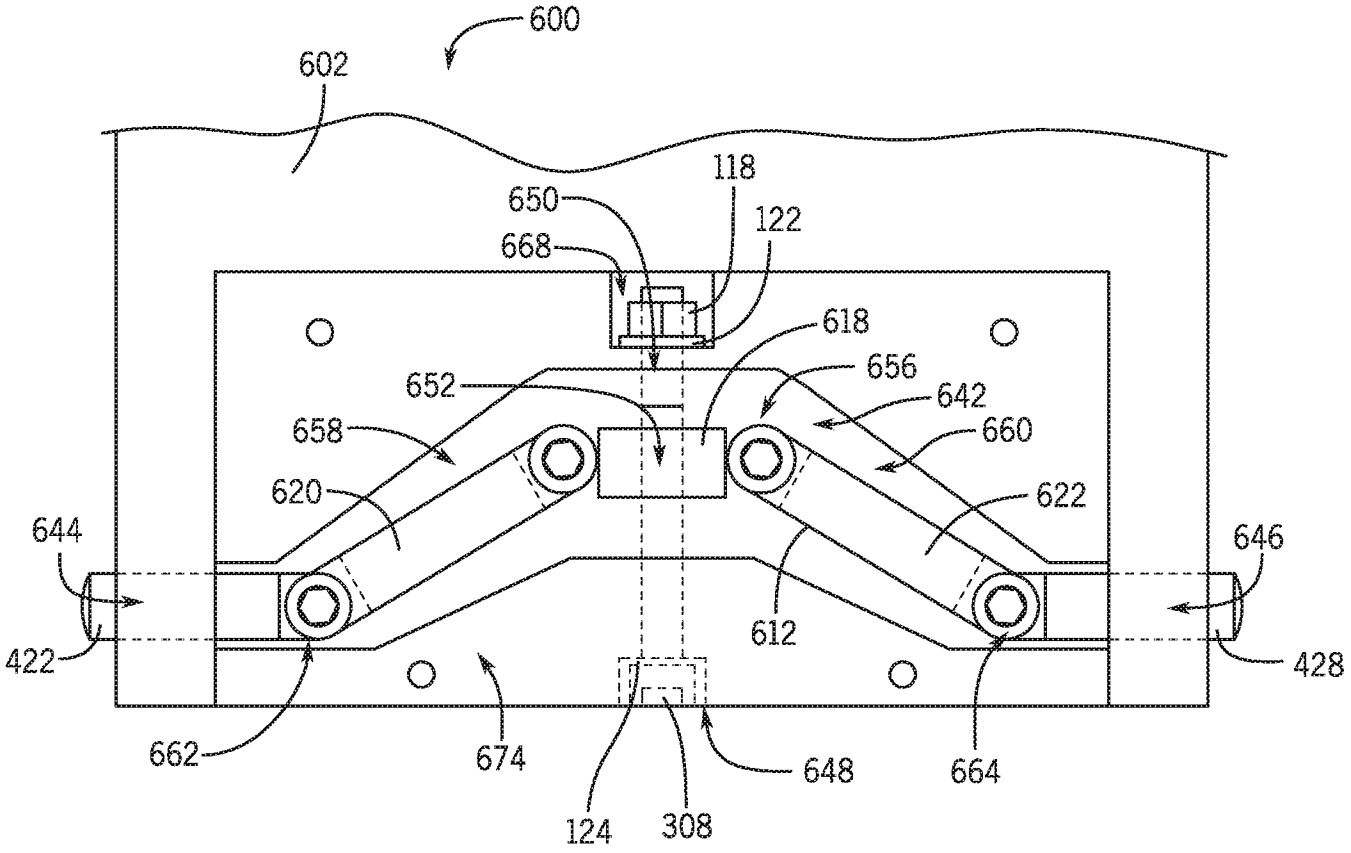
FIG. 24 shows a top view of the counterweight assembly of FIG. 23 with the cover removed.

As shown in FIG. 23, the counterweight 602 includes a cavity 642, a first opening 644, a second opening 646, a third opening 648, and a fourth opening 650. The position adjustment block 618 defines a fifth opening 652 having threads that threadingly engage the first adjustment screw 308. The cavity 642 includes a drive portion 656, a first wedge portion 658, a second wedge portion 660, a first guide channel 662, and second guide channel 664. The counterweight 602 also defines a chamber 668 and a recess 674. In some embodiments, the position adjustment block 618 is slidably disposed in the drive portion 656. The first adjustment screw 308 is threadingly engaged with the position adjustment block 618. The first adjustment screw 308 extends through the third opening 648, through and threadingly engages the position adjustment block 618, and through the fourth opening 650. The first adjustment screw 308 is threadingly engaged with the first nut 118. The first nut 118 and the first washer 122 are disposed in the chamber 668. The second washer 124 is disposed in the third opening 648. The first link 620 is slidably disposed in the first wedge portion 658. The second link 622 is slidably disposed in the second wedge portion 660. The first positioning rod 422 is slidably disposed in the first guide channel 662 and is extendable through the first opening 644. The second positioning rod 428 is slidably disposed in the second guide channel 664 and is extendable through the second opening 646. The position adjustment block 618 is pivotally coupled to the first link 620 and the second link 622. The first link 620 is pivotally coupled to the first positioning rod 422. The second link 622 is pivotally coupled to the second positioning rod 428.

When the position of the counterweight 602 is to be moved via the counterweight positioning system 603, the first adjustment screw 308 can be rotated in the direction 173 (e.g., tightened) with the position adjustment block 618 rotationally fixed (e.g., by the position adjustment block 618 contacting the counterweight 602) to advance the positioning adjustment block 618 toward the third opening 648. As the position adjustment block 618 moves toward the third opening 648, the position adjustment block 618 pushes the first link 620 and the second link 622. The first link 620 in turn pushes the first positioning rod 422, while the second link 622 in turn pushes the second positioning rod 428. In other words, when the first adjustment screw 308 is rotated in the direction 172, the positioning linkage assembly 612 articulates outwardly. Thus, the first positioning rod 422 extends outwardly from the counterweight 602 through the first opening 644 and the second positioning rod 428 extends outwardly from the counterweight 602 through the second opening 646. The first adjustment screw 308 can also be rotated in the direction 175 (e.g., loosened) with the position adjustment block 618 rotationally fixed (e.g., by the position adjustment block 618 contacting the cover 404) to advance the position adjustment block 618 toward the fourth opening 650. As the position adjustment block 618 moves toward the fourth opening 650, the position adjustment block 618 pulls the first link 620 and the second link 622. The first link 620 in turn pulls the first positioning rod 422. The second link 622 in turn pulls the second positioning rod 428. In other words, when the first adjustment screw 308 is rotated in the second direction 174, the positioning linkage assembly 612 articulates inwardly. Thus, the first positioning rod 422 retracts inwardly into the counterweight 602 through the first opening 644 and the second positioning rod 428 retracts inwardly into the counterweight 402 through the second opening 646.

In some embodiments, the fasteners 306 are threadingly engaged with the counterweight 602 to attach the cover 404 to the counterweight 602. The cover 404 is disposed in the recess 674 such that the first top surface 684 is generally flush with the second top surface 486. The cover 404, when installed, can allow for the block 618 to be rotationally fixed so that the block 618 can translate appropriately when the adjustment screw 308 is rotated (e.g., the rotation is blocked to allow translation).

Figure 25:
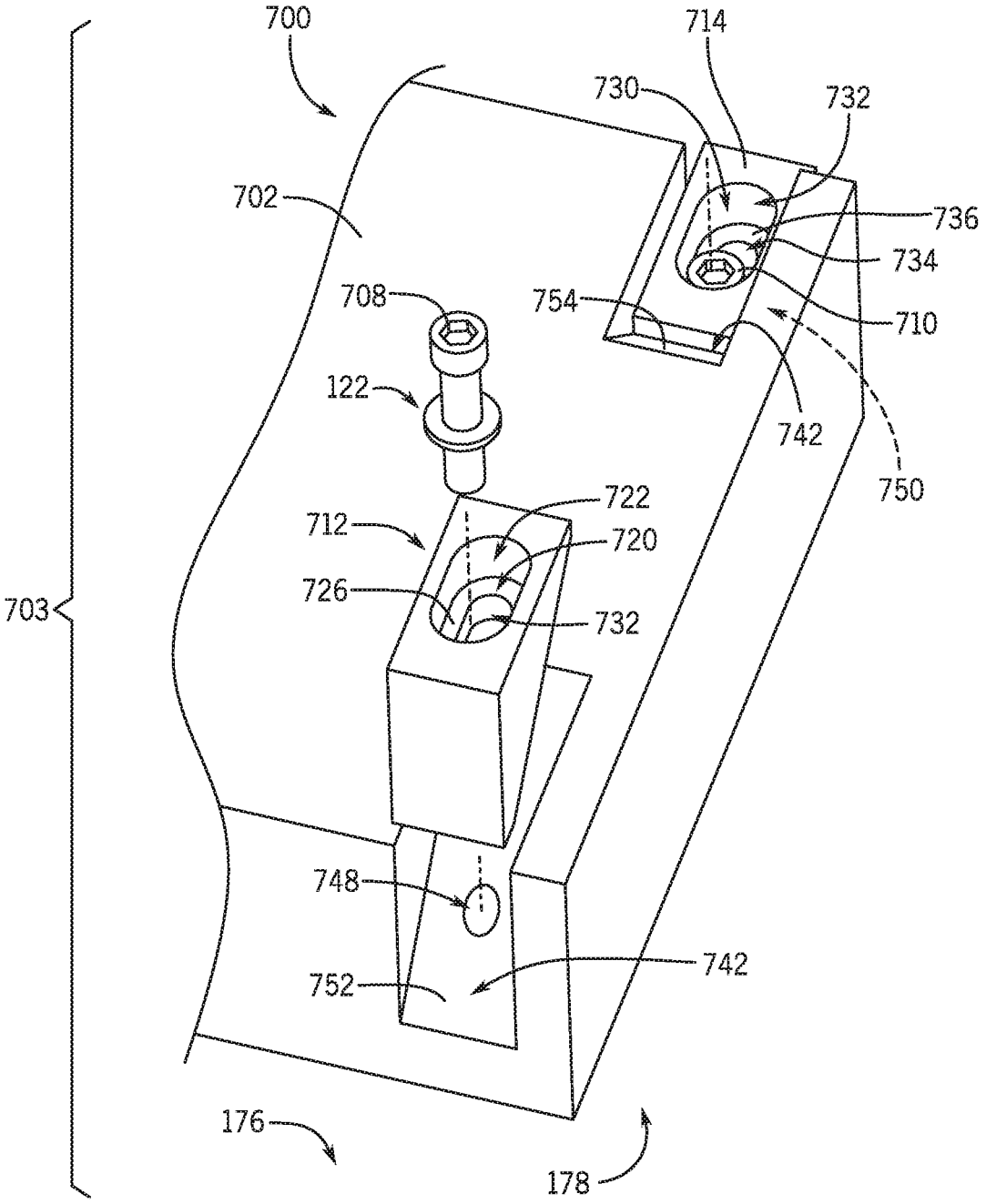
FIG. 25 shows a perspective view of another counterweight assembly.

FIG. 25 shows a side perspective view a counterweight assembly 700. The counterweight assembly 700 includes a counterweight 702, and a counterweight positioning system 703 having a first positioning screw 708, a second positioning screw 710, a first positioning wedge 712, a second positioning wedge 714, the first washer 122, and the second washer 124 (e.g., of the previous FIGS., which is obscured by the second positioning screw 710 in FIG. 25).

As shown, the first positioning wedge 712 includes a first slot 720 having a first portion 722 and a second portion 724. The first portion 722 is larger in cross-section than the second portion 724. Thus, the first portion 722 and the second portion 724 define a first shoulder 726 in the first positioning wedge 712. The second positioning wedge 714 includes a second slot 730 having a third portion 732 and a fourth portion 734. The third portion 732 is larger in cross-section than the fourth portion 734. Thus, the third portion 732 and the fourth portion 734 define a second shoulder 736 in the second positioning wedge 714.

In some embodiments, the counterweight 702 includes a first cavity 742, a second cavity 744, a first well 748, and a second well 750. The first cavity 742 and the second cavity 744 are sloped. The first well 748 and the second well 750 are internally threaded, and configured to threadingly engage the screws 708, 710, respectively. The second well 750 is obstructed from being viewed in FIG. 25 because the screw 710 has threadingly engaged the second well 750.

The counterweight 702 has a first slope 752 and a second slope 754. The first slope 752 partially defines the first cavity 742. The second slope 754 partially defines the second cavity 744. In some embodiments, the first positioning wedge 712 is disposed in the first cavity 742 and slidably engages with first slope 752. The first washer 122 is slidably disposed on the first shoulder 726 in the first portion 722. The first positioning screw 708 extends through the first slot 720 into the first well 748. The first positioning screw 708 is threadingly engaged with the counterweight 702. In some embodiments, the second positioning wedge 714 is disposed in the second cavity 744 and slidably engages with the second slope 754. The second washer 124 is slidably disposed on the second shoulder 736 in the third portion 732. The second positioning screw 710 extends through the second slot 730 into the second well. The second positioning screw 710 is threadingly engaged with the counterweight 702.

When the position of the counterweight 702 is to be moved via the counterweight positioning system 703, the first positioning screw 708 can be rotated in a direction 176 to advance the screw 708 and threadingly engage the well 748. As the screw 708 is further rotated in the direction 176, the first positioning wedge 712 is further pressed against the first slope 752 via the first washer 122 thereby translating the wedge 712 outwardly. In other words, because the first positioning wedge 712 and the first slope 752 are slanted, the first positioning wedge 712 is urged to translate outwardly relative to the counterweight 702 (e.g., when the screw 708 is further rotated). As the first positioning wedge 712 slides outwardly relative to the counterweight 702, the first positioning wedge 712 also slides outwardly relative to the first positioning screw 708 and the first washer 122 via the first slot 720. In other words, when the first positioning screw 708 is tightened (e.g., further rotated in direction 176), the first washer 122 slides along the first shoulder 726 to squeeze the first positioning wedge 712 outwardly against the first slope 752. Similarly, when the first positioning screw 708 is rotated in the direction 178 (e.g., loosened), the first positioning wedge 712 is freed to be pushed back inwardly against the first slope 752 into the first cavity 742 (e.g., by an external force). The second adjustment screw 710, the second position wedge 714, and the second washer 124 operate in a similar manner to the first adjustment screw 708, the first position wedge 712, and the first washer 122. Thus, the previous description of the operation of the first adjustment screw 708 with regard to the counterweight assembly 700 also pertains to the operation of the second adjustment screw 710 with regard to the counterweight assembly 700.

Figure 26:
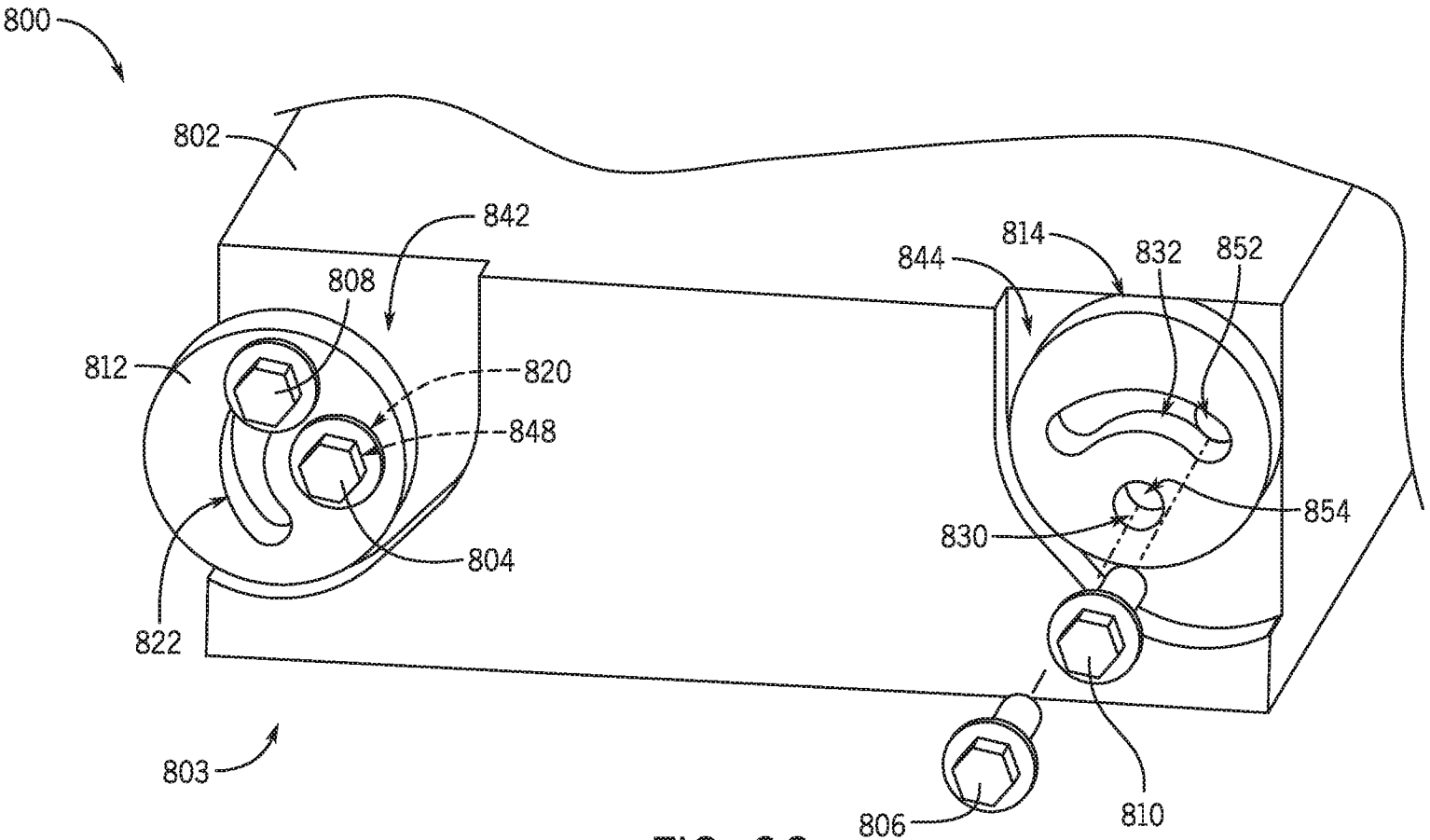
FIG. 26 shows a perspective view of another counterweight assembly.

FIG. 26 shows an example of a counterweight assembly 800. The counterweight assembly 800 includes a counterweight 802, a counterweight positioning system 803 having a first pivot screw 804, a second pivot screw 806, a first positioning screw 808, a second positioning screw 810, a first positioning disk 812, and a second positioning disk 814. The first positioning disk 812 defines a first opening 820 and a first slot 822. The second positioning disk 814 defines a second opening 830 and a second slot 832. The first opening is a mirror image of the second opening 830. The first slot 822 is a mirror image of the second slot 832.

As shown, the counterweight 802 includes a first recess 842, a second recess 844, a first well 846, a second well 848, a third well 852, and a fourth well 854. The first well 846 is a mirror image of the third well 852. The second well 848 is a mirror image of the fourth well 854. The first positioning disk 812 is slidably disposed in the first recess 842. The first pivot screw 804 extends through the first positioning disk 812 via the first opening 820. The first pivot screw 804 extends into the second well 848. The first pivot screw 804 is threadingly engaged with the counterweight 802. The first positioning screw 808 extends through the first positioning disk 812 via the first slot 822. The first positioning screw 808 extends into the first well 846. The first positioning screw 808 is threadingly engaged with the counterweight 802. The first positioning disk 812 is rotatably engaged with the first pivot screw 804. The first positioning disk 812 is slidably engaged with the first positioning screw 808.

The second positioning disk 814 is slidably disposed in the second recess 844. The second pivot screw 806 extends through second positioning disk 814 via the second opening 830. The second pivot screw 806 extends into the fourth well 854. The second pivot screw 806 is threadingly engaged with the counterweight 802. The second positioning screw 810 extends through the second positioning disk 814 via the second slot 832. The second positioning screw 810 extends into the second well 850. The second positioning screw 810 is threadingly engaged with the counterweight 802. The second positioning disk 814 is rotatably engaged with the second pivot screw 806. The second positioning disk 814 is slidably engaged with the second positioning screw 810.

When the position of the counterweight 802 is to be moved via the counterweight positioning system 803, screws 804, 808 can be inserted through the respective openings or slots in the disk 812 and rotated in the direction 173 (e.g., to tighten) to interface with the respective wells 846, 848 in such a way so as to also allow rotation or pivoting of the disk 812. Then, the first positioning disk 812 can be rotated (e.g., outwardly) relative to the counterweight 802 about the first pivot screw 804, and along the first slot 822. When the first positioning disk 812 reaches a desired location (e.g., in contact with a slot in the forklift frame), the screws 804, 808 can be rotated in the direction 173 to further tighten the screws 804, 808 against the first positioning disk 812 (and the counterweight 802). Thus, the first positioning disk 812 is retained in the desired location. In some cases, the screws 804, 808 can be rotated in the direction 175 to loosen the first positioning disk 812 from the counterweight 802. Thus, the first positioning disk 812 may be rotated again about the first pivot screw 804 back into the first recess 842. The screws 806, 810, and the disk 814 operate in a similar manner to the screws 804 808, and the disk 812. Thus, the previous description of the operation of the screws 804, 808, and the disk 812 also pertain to the operation of the screws 806, 810, and the disk 814.

From the foregoing, it will be appreciated that the above first, second, third, fourth, fifth, sixth, seventh, and eighth counterweight assemblies 100, 200, 300, 400, 500, 600, 700, 800 are adaptable and adjustable to be installed on material handling vehicle bodies having varying geometry. It is also to be appreciated that any of the counterweight assemblies can be hydraulically or electrically actuated, for example. Additionally, the examples of the counterweight assemblies 100, 200, 300, 400, 500, 600, 700, 800 and corresponding counterweight positioning systems 104, 204, 303, 403, 503, 603, 703, 803 are understood to be substituted for the counterweight assembly 24, and the counterweight positioning system 38 of the material handling vehicle 10, with appropriate modifications (e.g., such as protrusions, or wells in the frame 12, etc.). In other words, the counterweight assemblies, and counterweight positioning systems of the disclosure are substitutable. In fact, the counterweight assemblies 100, 200, 300, 400, 500, 600, 700, 800 are specific implementations of the counterweight assembly 24, and similarly, the corresponding counterweight positioning systems 104, 204, 303, 403, 503, 603, 703, 803 are specific implementations of the counterweight assembly 24.

Figure 27:
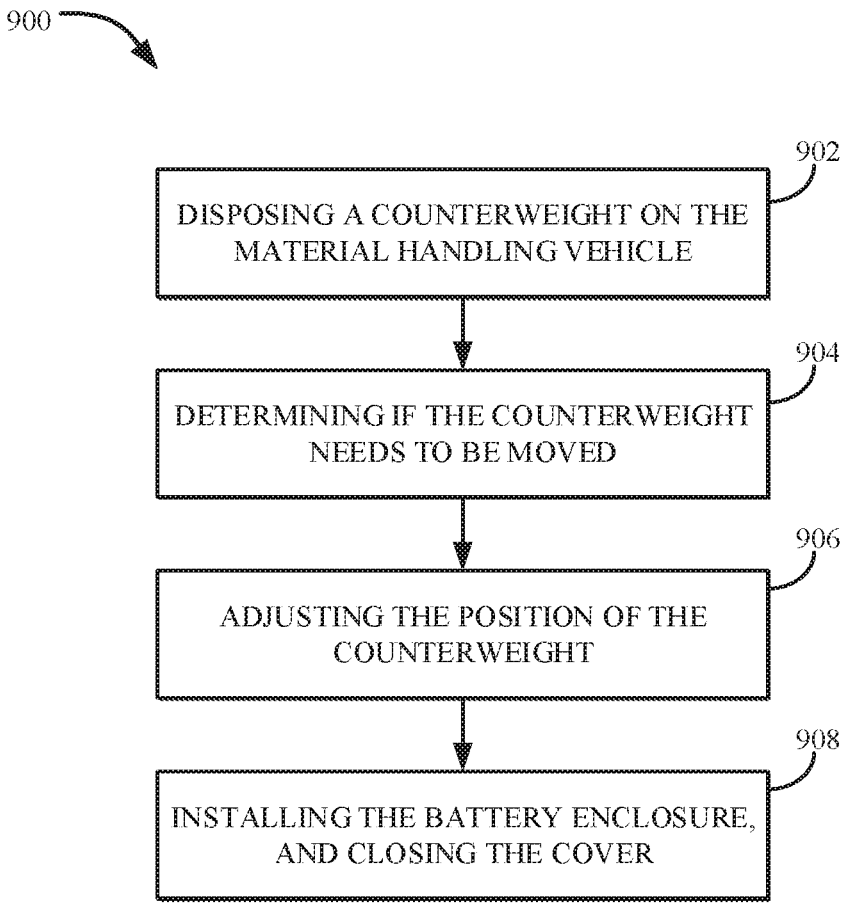
FIG. 27 shows a flowchart of a process for installing a counterweight on a material handling vehicle.

FIG. 27 shows an example of a flowchart of a process 900 for installing a counterweight on a material handling vehicle. At 902, process 900 includes disposing a counterweight on a material handling vehicle. In some cases, a user can select a counterweight and position the counterweight on a frame (e.g., frame 12) of a material handling vehicle (e.g., the material handling vehicle 10). Additionally, a user may adjust the orientation of the counterweight, such that the counterweight is orientated properly. At 904, process 900 includes determining whether the counterweight needs to be moved or positioned differently. In some cases, the counterweight does not need to be moved, as the components such as the cover, and mounting structures, are aligned. However, in other cases, the counterweight may need to be moved, such that the mounting structures are properly aligned, and the cover interfaces with the counterweight. At 906, process 900 includes adjusting the position of the counterweight, which can include the operation of the previously described counterweight positioning systems. For example, generally, the counterweight positioning system can include a first positioning member, a second positioning member, and a positioning adjuster that adjusts the position of the first positioning member and the position of the second positioning member. Prior to adjustment, the first positioning member is aligned with a first slot (or a first protrusion) in the frame of the material handling vehicle. Similarly, the second positioning member is aligned with a second slot (or a second protrusion) in the frame of the material handling vehicle. Then, the counterweight can be moved (or shifted) accordingly (e.g., in a rearward direction, or in a frontward direction) to the desired position, which can include aligning a mounting structure coupled to the counterweight relative to an aperture (or window) in the frame of the material handling vehicle. Once the counterweight is positioned accordingly, the first positioning member is advanced (via the positioning adjuster) past the counterweight and into the first slot, such that the first positioning member contacts the frame (via the slot, or protrusion). Similarly, the first positioning member is advanced (via the positioning adjuster) past the counterweight and into the second slot, such that the second positioning member contacts the frame (via the slot, or protrusion). In some cases, the counterweight may be adjusted after advancement of the positioning members. In this case, depending on the type of adjustment, the first positioning member can be retreated toward the counterweight, followed by movement of the counterweight toward the first slot (or protrusion) in the frame. Then, the second positioning member can be extended, and advanced away from the counterweight. Alternatively, the second positioning member can be retreated toward the counterweight, followed by movement of the counterweight toward the second slot (or protrusion) in the frame. Then, the first positioning member can be extended, and advanced away from the counterweight.

At 908, process 900 can include installing the battery enclosure, and closing the cover (e.g., the cover 18), such as after the counterweight has been adjusted. For example, the battery enclosure can be placed through the aperture (or window) in the frame, and secured to the mounting structure coupled to the counterweight. Additionally, the cover can be closed and thereby engaged with the counterweight, such as after the counterweight has been positioned.

While various spatial and directional terms, such as top, bottom, lower, mid, lateral, horizontal, vertical, front, and the like may be used to describe examples of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A material handling vehicle comprising:

a frame having an aperture directed through the frame, a first slot directed into the frame, and a second slot directed into the frame opposite the first slot, the aperture being configured to receive a battery pack; and a counterweight assembly including:

a counterweight having a first opening, and an opposite second opening;

a first positioning rod having a first end, and an opposite second end, the first end being directed through the first opening; and a first nut threadingly engaged with the second end of the first positioning rod, and wherein the first nut is configured to be rotated in a first direction to advance the first end of the first positioning rod farther through the first opening and into the first slot of the frame, thereby adjusting the position of the counterweight relative to the frame.

2. The material handling vehicle of claim 1, wherein the first nut is an adjusting shaft having a hole directed therethrough, a first portion, and a second portion opposite the first portion, the first portion having first threads, and the second portion having second threads, the first threads being opposite in direction to the second threads, and wherein the first portion threadingly engages the second end of the first positioning rod.

3. The material handling vehicle of claim 2, wherein the frame includes a first slot directed into the frame, and a second slot opposite the first slot directed into the frame, wherein the counterweight assembly includes a second positioning rod having a third end, and an opposite fourth end, the third end being directed through the second opening, the fourth end threadingly engaged with the second portion of the adjusting shaft, and wherein the adjusting shaft is rotated in the first direction to advance the first end of the first positioning rod through the first opening by a first amount and into the first slot of the frame, and to retreat the fourth end of the second position rod through the second opening by a second amount, thereby adjusting the position of the counterweight relative to the frame.

4. The material handling vehicle of claim 3, wherein the first amount and the second amount are the same, such that rotation of the adjusting shaft causes advancement of the first positioning rod and retreating of the second position rod by the same amount.

5. The material handling vehicle of claim 4, wherein the counterweight has a cavity directed therethrough, and wherein the adjustment shaft is positioned within the cavity.

6. The material handling vehicle of claim 5, wherein the first slot, the second slot, the first opening, the second opening are all collinear.

7. The material handling vehicle of claim 6, wherein the counterweight assembly further includes a first washer, and a second washer, the first washer positioned in the cavity and between the first portion of the adjusting shaft and the first positioning rod, and wherein the second washer is positioned in the cavity and between the second portion of the adjusting shaft and the second positioning rod.

8. The material handling vehicle of claim 1, wherein the first opening of the counterweight, the first end of the first positioning rod, and a first slot of the frame all have the same shape.

9. The material handling vehicle of claim 8, wherein the shape is a rectangular prism.

10. The material handling vehicle of claim 1, further comprising a mounting structure coupled to the counterweight and configured to engage with and secure the battery pack, and wherein the adjustment of the position of the counterweight relative to the frame adjusts the position of the mounting structure relative to the aperture of the frame.

11. The material handling vehicle of claim 1, further comprising a cover pivotally coupled to the frame, the cover configured to interface with the counterweight.

12. The material handling vehicle of claim 1, wherein the counterweight assembly further includes:

a second positioning rod having a third end, and an opposite fourth end, the fourth end being directed through the second opening; and a second nut threadingly engaged with the third end of the second positioning rod, and wherein rotation of the second nut in the first direction advances the fourth end of the second positioning rod farther through the second opening and into a second slot of the frame, thereby adjusting the position of the counterweight relative to the frame.

13. The material handling vehicle of claim 12, wherein the counterweight includes a first cavity, and a second cavity, wherein the first nut is positioned in the first cavity, and wherein the second nut is positioned in the second cavity.

14. A method for installing a counterweight on a material handling vehicle, the method comprising:

providing a counterweight assembly including:

a counterweight having a first opening and an opposite second opening;

a counterweight positioning system having a first positioning rod having a first end and an opposite second end, the first end being directed through the first opening; and a first nut threadingly engaged with the second end of the first positioning rod;

placing the counterweight on a frame of the material handing vehicle, the frame having an aperture being configured to receive a battery pack, the frame including a first slot directed into the frame and a second slot directed into the fame opposite the first slot;

advancing the first positioning rod by rotating the first nut in a first direction to advance the first end of the first positioning rod farther through the opening and into the first slot of the frame thereby adjusting the position of the counterweight relative to the frame.

15. The method of claim 14, wherein the frame has a first side, and an opposite second side, and the method further comprising:

retreating the first positioning rod towards the counterweight and away from the first side of the frame;

moving the counterweight towards the first side of the frame; and advancing a second positioning member of the counterweight positioning system to extend farther from the counterweight and until the second positioning member is inserted into the second slot of the frame.

16. The method of claim 14, wherein the frame has a first side, and an opposite second side, and the method further comprising:

retreating a second positioning member of the counterweight positioning system towards the counterweight and away from the second side of the frame;

moving the counterweight towards the second side of the frame; and advancing the first positioning rod to extend farther from the counterweight and until the first positioning rod is inserted into the first slot of the frame.

17. A material handling vehicle comprising:

a frame having an aperture directed through the frame, a first slot directed into the frame, and a second slot directed into the frame opposite the first slot, the aperture being configured to receive a battery pack; and a counterweight assembly including:

a counterweight having a first well and a second well;

a positioning disk including an opening and a third slot;

a first pivot fastener extending through the opening of the positioning disk and into the first well of the counterweight;

a second pivot fastener extending through the third slot of the positioning disk and into the second well of the counterweight;

wherein the positioning disk is configured to be rotated outwardly about the first pivot fastener to advance the positioning disk into the first slot of the frame, thereby adjusting the position of the counterweight relative to the frame.

18. The material handling vehicle of claim 17, wherein the positioning disk is a first positioning disk and the opening is a first opening;

wherein the counterweight includes a third well and a fourth well;

wherein the counterweight assembly includes:

a second positioning disk including a second opening and a fourth slot;

a third pivot fastener extending through the second opening of the second positioning disk and into the third well of the counterweight;

a fourth pivot fastener extending through the fourth slot of the second positioning disk and into the fourth well of the counterweight;

wherein the second positioning disk is configured to be rotated inwardly about the third pivot fastener into the counterweight to adjust the position of the counterweight relative to the frame.

19. The material handling vehicle of claim 17, wherein the counterweight includes a recess; and wherein the positioning disk is positioned within the recess of the counterweight.

20. The material handling vehicle of claim 17, wherein the third slot of the positioning disk is curved; and wherein the third slot of the positioning disk is positioned above the opening of the positioning disk.

* * * * *